US009249567B2

(12) United States Patent
Yu et al.

(10) Patent No.: US 9,249,567 B2
(45) Date of Patent: Feb. 2, 2016

(54) REUSABLE ARCHITECTURAL WALL

(75) Inventors: Shawn Yu, Hudsonville, MI (US); Bryan R. Gingrich, Holland, MI (US); Robert L. Tuttle, Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 13/191,144

(22) Filed: Jul. 26, 2011

(65) Prior Publication Data

US 2013/0025220 A1 Jan. 31, 2013

(51) Int. Cl.

*E04B 2/74* (2006.01)
*E04B 2/82* (2006.01)
*E04F 15/024* (2006.01)

(52) U.S. Cl.

CPC ..... *E04B 2/7425* (2013.01); *E04B 2/7448* (2013.01); *E04B 2/828* (2013.01); *E04B 2002/742* (2013.01); *E04B 2002/749* (2013.01); *E04B 2002/7446* (2013.01); *E04B 2002/7483* (2013.01); *E04B 2002/7488* (2013.01); *E04F 15/024* (2013.01)

(58) Field of Classification Search

CPC ..... E04B 2002/7487; E04B 2/7425; E04B 2002/7466; E04B 2/7448; E04B 1/6137; E04B 2002/742; E04B 2/7818; E04B 2/828; E04B 2002/7483; E04B 2002/749; E04C 2/34; E04C 2002/004; E04C 2/296; E04C 2/3405; E04C 2/38; E04F 15/024

USPC ..... 52/36.1, 36.4, 36.5, 220.7, 238.1, 239, 52/481.1, 481.2

See application file for complete search history.

(56) References Cited

U.S. PATENT DOCUMENTS

| | | | | | |
|---|---|---|---|---|---|
| 2,891,638 | A | * | 6/1959 | Grundy et al. | 52/578 |
| 3,312,032 | A | * | 4/1967 | Ames | 52/580 |
| 3,667,180 | A | * | 6/1972 | Tischuk | 52/309.2 |
| 3,789,567 | A | * | 2/1974 | Rae et al. | 52/584.1 |
| 3,848,364 | A | * | 11/1974 | Costruba | 52/36.5 |
| 4,037,380 | A | * | 7/1977 | Pollock | 52/475.1 |
| 4,060,294 | A | * | 11/1977 | Haworth et al. | 439/215 |
| 4,084,367 | A | * | 4/1978 | Saylor et al. | 428/113 |
| 4,269,005 | A | * | 5/1981 | Timmons | 52/36.6 |
| 4,351,475 | A | * | 9/1982 | Hudson | 237/46 |
| 4,550,543 | A | * | 11/1985 | Valenzano | 52/309.7 |
| 4,682,457 | A | * | 7/1987 | Spencer | 52/239 |
| 4,798,035 | A | * | 1/1989 | Mitchell et al. | 52/281 |
| 4,852,317 | A | * | 8/1989 | Schiavello et al. | 52/239 |
| 5,125,201 | A | * | 6/1992 | Pieters et al. | 52/238.1 |
| 5,277,005 | A | * | 1/1994 | Hellwig et al. | 52/220.1 |
| 5,305,567 | A | * | 4/1994 | Wittler | 52/238.1 |
| 5,394,668 | A | * | 3/1995 | Lim | 52/483.1 |
| 5,396,750 | A | * | 3/1995 | Kleyn | 52/792.11 |
| 5,444,955 | A | * | 8/1995 | Ou | 52/309.9 |
| 5,644,877 | A | * | 7/1997 | Wood | 52/241 |
| 5,784,843 | A | * | 7/1998 | Greer et al. | 52/220.7 |
| 6,085,485 | A | * | 7/2000 | Murdock | 52/783.19 |

(Continued)

*Primary Examiner* — Joshua J Michener
*Assistant Examiner* — Babajide Demuren
(74) *Attorney, Agent, or Firm* — Warner Norcross & Judd LLP

(57) ABSTRACT

A reusable architectural wall is provided which provides a cost-effective space-dividing wall structure formed of internal support rails joined by a lightweight, cost effective facing panel on each panel side, which preferably is formed of standard architectural materials such as gypsum board, R-board and the like. The wall is structurally rigid, field cuttable, installable horizontally or vertically and has a substantial acoustic reduction, cable carrying capacity, and HVAC capability.

22 Claims, 29 Drawing Sheets

(56) References Cited

U.S. PATENT DOCUMENTS

| | | | | |
|---|---|---|---|---|
| 6,105,322 | A * | 8/2000 | Chang | 52/238.1 |
| 6,128,876 | A * | 10/2000 | Nitschke et al. | 52/239 |
| 6,134,852 | A * | 10/2000 | Shipman et al. | 52/220.7 |
| 6,286,275 | B1 * | 9/2001 | Edwards | 52/238.1 |
| 6,314,704 | B1 * | 11/2001 | Bryant | 52/745.1 |
| 6,418,671 | B1 * | 7/2002 | DeRuiter et al. | 52/36.4 |
| 6,502,357 | B1 * | 1/2003 | Stuthman et al. | 52/241 |
| 6,658,808 | B1 * | 12/2003 | Doherty et al. | 52/580 |
| 6,834,468 | B1 * | 12/2004 | Kroie | 52/590.2 |
| 7,197,853 | B1 * | 4/2007 | Little, Jr. | 52/238.1 |
| 7,238,106 | B2 * | 7/2007 | Scott | 454/306 |
| 2001/0013209 | A1 * | 8/2001 | Waalkes et al. | 52/239 |
| 2002/0088188 | A1 * | 7/2002 | Chang | 52/238.1 |
| 2002/0112443 | A1 * | 8/2002 | Shipman et al. | 52/745.13 |
| 2002/0157335 | A1 * | 10/2002 | Vos | 52/238.1 |
| 2002/0189180 | A1 * | 12/2002 | King et al. | 52/243 |
| 2003/0041540 | A1 * | 3/2003 | Gravel et al. | 52/239 |
| 2004/0060245 | A1 * | 4/2004 | Loblick et al. | 52/79.5 |
| 2004/0093805 | A1 * | 5/2004 | Underwood et al. | 52/36.1 |
| 2005/0108964 | A1 * | 5/2005 | Brinkkotter | 52/455 |
| 2006/0230700 | A1 * | 10/2006 | Chen | 52/586.1 |
| 2008/0209827 | A1 * | 9/2008 | Webb | 52/220.7 |
| 2010/0186326 | A1 * | 7/2010 | Cummings et al. | 52/239 |
| 2011/0126487 | A1 * | 6/2011 | Browning et al. | 52/586.1 |
| 2011/0258943 | A1 * | 10/2011 | De Zen et al. | 52/43 |

* cited by examiner

FIG. 4
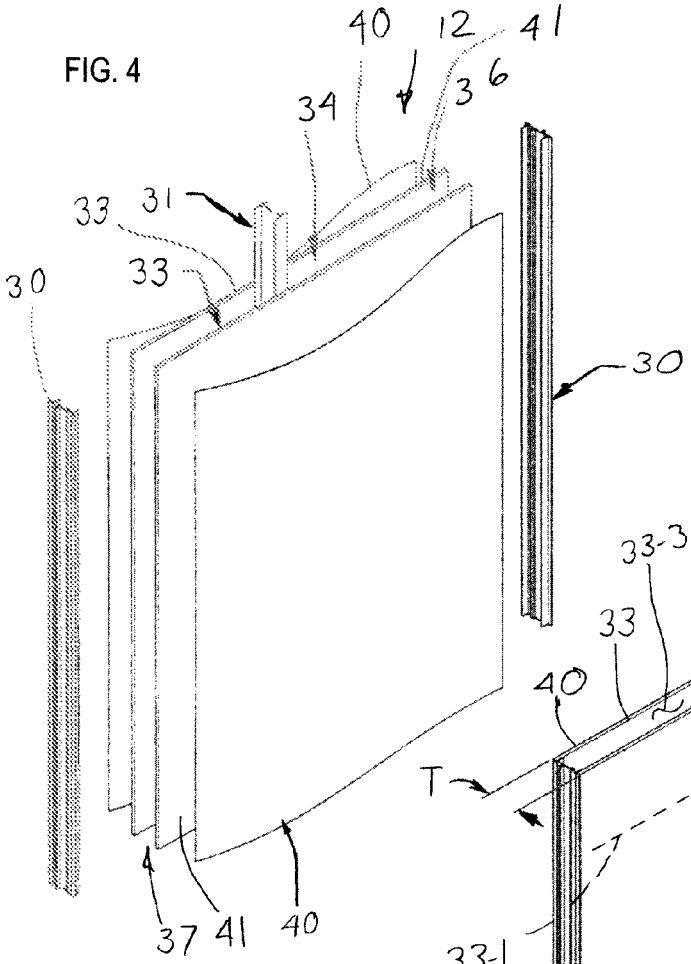
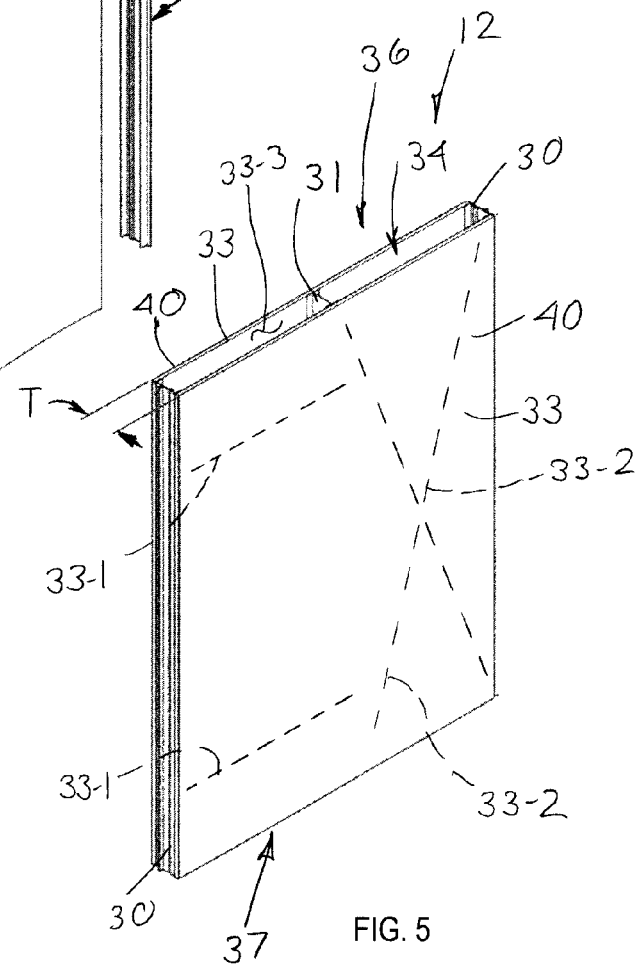
FIG. 5

FIG. 14
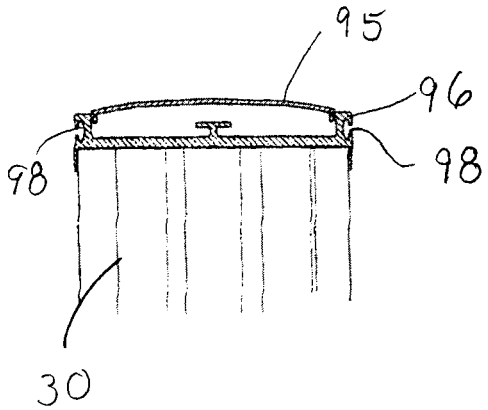
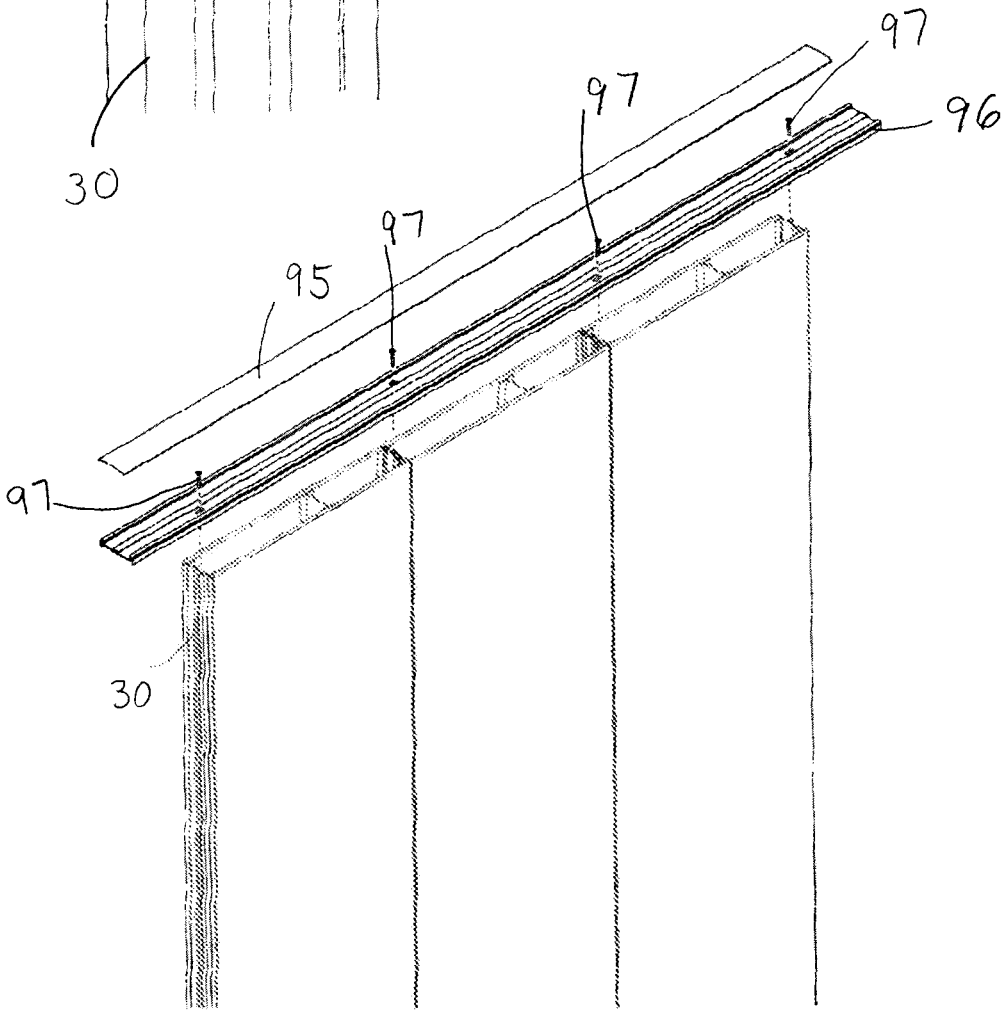
FIG. 13

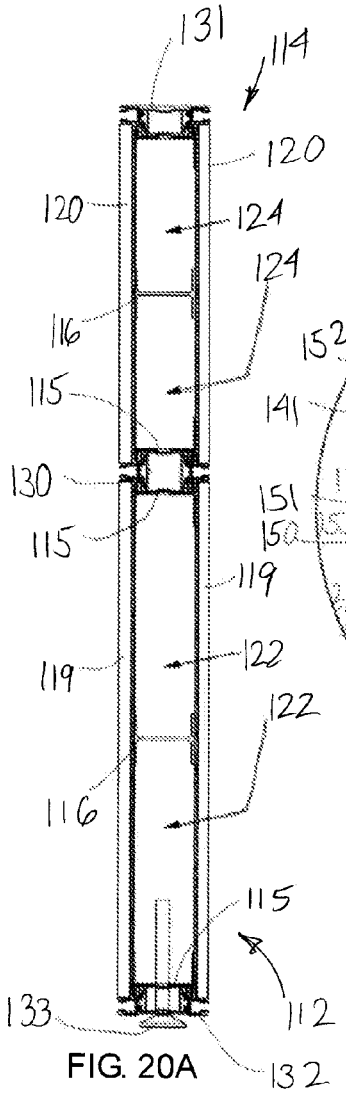
FIG. 20A
FIG. 20B
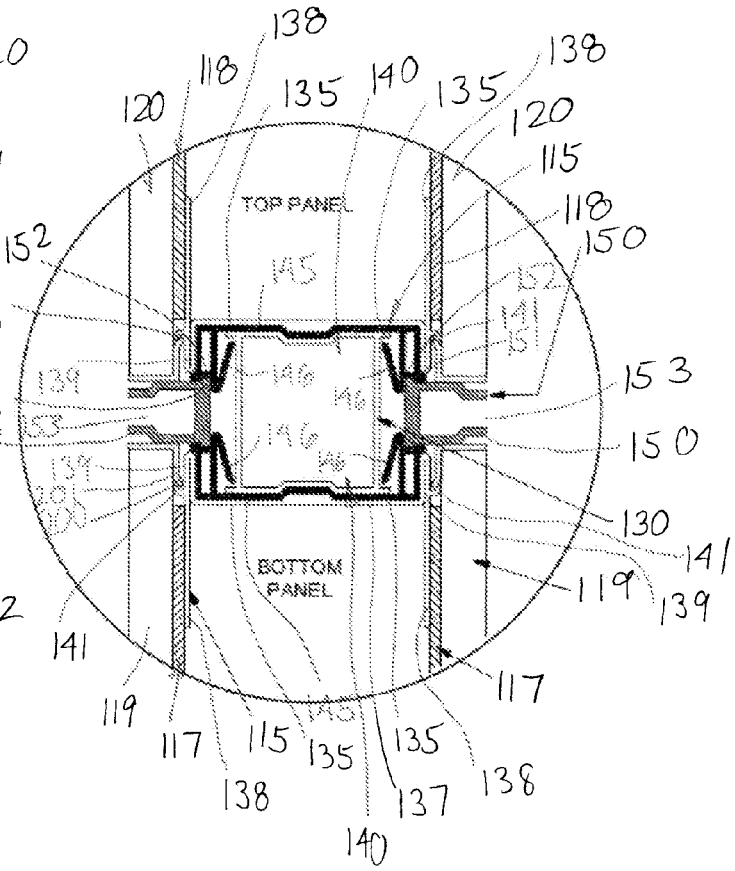

176
162
163
168
164
168
166
163
163
167
164
167
165
161
163
178
177

162
166
163
180
166
181
TOP PANEL
181
185
180
183
183
185
182
183
175
182
180
BOTTOM PANEL
165
165
181
163
180
181
161

REUSABLE ARCHITECTURAL WALL

FIELD OF THE INVENTION

The invention relates to an architectural wall system formed of premanufactured architectural walls, which are used to subdivide open building spaces, and provide a cost-effective, space-dividing wall structure.

BACKGROUND OF THE INVENTION

Commercial buildings typically include large open office areas which are divided into smaller work spaces or workstations by any of a number of space divider and panel systems that have been developed therefor. These space divider arrangements typically employ upright space-dividing wall panels which serially connect together to subdivide the office area into a plurality of smaller workstations of desired size and configuration. Such panels are typically less than floor-to-ceiling height, and cooperate with other furniture components to define an equipped workstation. These components may include work surfaces, file cabinets, shelf units and the like which mount directly on and are supported by the wall panels, and may also include freestanding furniture components such as tables, chairs and file cabinets. A wide variety of such wall panel systems are known.

These space-dividing wall panels may be preferred in many cases over the well known method of constructing "hard" or permanent architectural building walls such as by the use of studs and drywall. Known wall panel systems achieve substantially the same result of subdividing a building space, while also providing flexibility in being able to disassemble and move such walls when reconfiguring the building space.

In subdividing open office areas into individual workstations, the individual wall panel assemblies have a variety of constructions. Typically, a plurality of upright space-dividing wall panels are employed which serially connect together through two-panel straight or angled connections, or through suitable three or four-panel connections, to subdivide the office area into the plurality of smaller workstations.

In one type of arrangement, a common panel construction is used to construct all of the walls of the workstations whereby each panel is individually connectable with serially-adjacent panels through the aforementioned straight or corner connections. With such an arrangement, a group of workstations can be formed, for example, with a common central section of wall panels separating one row of workstations on one side of the central section from a separate row of workstations formed on the opposite side thereof.

In these conventional wall panel systems, provision usually is made for the mounting of various office furniture components thereto such as desks, overhead storage cabinets, shelves and the like. To accommodate these furniture components, the wall panels are typically constructed with load-bearing, structurally rigid internal frames, which bear the load of the equipment mounted thereon. These frames often include slots, channels and the like to which the furniture components as well as other wall panels are mounted. The frames then are provided with aesthetic sheet-like covers which mount to the internal frame to close off the internal cavities. Typically, these covers are removable, and do not serve to structurally rigidify the frame.

Since each workstation usually requires power as well as communications capability such as for computers and telephones or the like, the wall panels preferably have power and telecommunications cabling within interior raceways thereof. The covers provide removable access to such interior chambers for the laying and routing of cabling.

For a load-bearing wall panel system, the costs are more significant to accommodate the load-bearing needs of such system.

It is an object of the invention to provide a readily reconfigurable space-dividing architectural wall system which provides a lower cost, and more flexible solution for subdividing building spaces.

In view thereof, the present invention relates to a space-dividing architectural wall system, which comprises lower cost, but structurally capable wall panels to create work spaces in an open building area. The wall panels of such system are defined by a less-complex construction comprising elongate internal support rails preferably oriented in parallel and facing panels that are non-removably fastened to the opposite faces of the internal rails to define a structurally rigid tubular structure. The rails maintain the facing panels in spaced relation and the rails and facing panels are fixed together to define a rigid wall panel. The wall panels therefore preferably define rigid box-like structures that can be oriented horizontally and stacked one above the other, or oriented vertically and positioned sidewardly adjacent to each other. These fundamental box-like wall structures provide the basic building blocks for constructing building walls in a variety of configurations. While these walls provide advantages of conventional walls using typical construction materials, they also provide substantial flexibility in configuring and reusing the wall panels and fitting the wall panels to specific office spaces.

Since the rails are oriented in parallel and since cross-rails are not required to be cross-connected to the support rails due to the structural rigidity of the facing panels, the wall panels essentially can be open ended in the lengthwise directions of the support rails which provides internal access to these panel cavities defined between the support rails. The panel cavities allow for the laying of cabling therethrough, and the facing panels can be ported in the field such as by available cutting tools, for mounting of electrical receptacles and the like.

With this construction, the facing panels form part of the rigid panel structure in that the support rails provide some strength and rigidity but the facing panels also provide rigidity lengthwise relative to the rails and also crosswise or laterally relative thereto. Accordingly, the facing panels themselves when bonded to the support rails provide load-bearing support to the wall panel. Notably, the rigidity of the facing panels is reinforced by the bonding to the support rails which allows a particular wall panel to be oriented either vertically wherein the support rails extend vertically, or horizontally wherein the support rails extend horizontally. When oriented horizontally, the face-wise rigidity of the facing panels is able to carry vertical loads independent of the support rails which extend horizontally and therefore do not carry the vertical loads. In this instance, the support rails would structurally support the facing panels by preventing bowing or buckling of the facing panel under vertical load since the support rails are bonded to the opposite facing panels and maintains same in parallel, planar orientations relative to each other. While the facing panels can provide structural support solely by their inherent rigidity, the facing panels may also comprise additional structural support through the provision of other rigidifying means. For example, a facing panel may be provided with reinforcement structure such as internal ribs on the inside panel faces within the cavities which ribs may be attached by bonding or other means to the inside faces wherein one example of such ribs could be defined by rails having a v-shaped cross-section which are bonded to the inside panel face. The ribs also could be formed integral with the facing panel such as by corrugations or ridges formed in the panel material such as by molding or pressing of the facing panel. The ribs may extend lengthwise or crosswise or at angular orientations relative to these directions, or even be provided so as to extend in two or more of these directions, such as in a grid pattern. Preferably, the reinforcement structure on the facing panels is not fixed to the support rails, and preferably has a relatively low profile so as to keep the cavities open within the panel interior to allow for the passage of air, cabling or the like.

As an additional means of providing reinforcement to the facing panels, the cavities could be partially or completely filled with a flowable filler material such as foam that bonds to the interior cavity faces defined at least by the facing panels. The foam then hardens and rigidifies the wall panel structure without requiring cross-wise extending cross rails joined to the support rails in a rectangular frame like conventional wall panels. The foam could completely fill a cavity or could only partially fill a cavity so that cable or air passages are formed in the cavity in combination with the filler material which bonds between or forms a reinforcing bridge between the facing panels within a cavity.

The cavities also may be filled with insulation materials for sound absorption and reduction. The insulation materials need not be bonded to the facing panels.

The support rails at the opposite side edges of the facing panels also have a preferred profile which forms structurally rigid joints between two serially-adjacent wall panels. Preferably, the edge-located support rails are configured to provide an interfitting, self aligning construction with no separate or loose fasteners when joining two wall panels together. In the preferred form of the invention, adjacent wall panels could be locked together at their side edges solely by displacement of one wall panel toward the other. As such, the wall panels can be connected directly together along their longitudinal side edges in a variety of configurations. For example, the wall panels can be configured so as to extend floor-to-ceiling or terminate at shorter heights below the ceiling. Also, the wall panels can be stacked together when oriented horizontally, or positioned side-by-side when oriented vertically, or joined together in combinations of horizontal and vertical orientations. The horizontally stacked wall panels and their edge-connecting support rails allow for wall runs of panels having substantial lengths while minimizing the necessity of perpendicular support structures such as return walls, building posts or the like. These wall runs preferably can span 24 feet between the supports.

Also, the support rails preferably are configured to optionally include off-modular mounting rails that allow for the connection of various furniture components thereto in both modular and off-modular locations along the length of a wall panel.

Preferably, the facing sheets are formed of readily available and typically inexpensive sheets of known architectural or construction materials such as gypsum board, R-board, particle board, mineral board, and cement fiber board, wherein the support rails can be formed of metal studs and insulation may also be provided for improved acoustic performance.

If desired, sheet-like removable covers may be mounted over the facing sheets to vary the aesthetic appearance of the wall panels. If desired, the facing sheets can be thin structurally rigid materials provided in combination with the covers so as that the total thickness of these two layers is essentially the same as conventional facing sheets such as gypsum board or drywall. This preserves a consistent thickness for the wall panels, whether a single layer of facing sheets are provided on each panel side or else a double layer of facing sheets/covers is provided.

Since the wall panels are constructed of support rails and facing sheets which can be conventional construction materials, the wall panels may be readily field cuttable to vary the overall panel length to the space dimensions of the building space. As such, the wall panels can be readily cut to length in the field by an installer to readily adapt the wall panels to the building space and the wall panels need not be restricted to lengths defined during manufacture. This also allows the panel ends to preferably be provided with a right angled edge relative to the panel side edges, and then be field cut at angles which might be dictated by the slope of a floor and/or ceiling.

Other objects and purposes of the invention, and variations thereof, will be apparent upon reading the following specification and inspecting the accompanying drawings.

BRIEF DESCRIPTION OF THE DRAWINGS

FIG. 4 is an exploded perspective view showing a first embodiment of a wall panel of the invention.

FIG. 5 is perspective showing the assembled wall panel.

FIG. 8A is a perspective view a wall panel configuration.

FIG. 8B is an enlarged side view of a joint between two wall panels.

FIG. 13 is an exploded perspective view of a top edge of a plurality of wall panels.

FIG. 14 is an end view of the top panel edge.

FIG. 20A is an end view of the wall panel having demountable covers.

FIG. 20B is an enlarged partial view of the wall panel of FIG. 20A.

Figure 1:
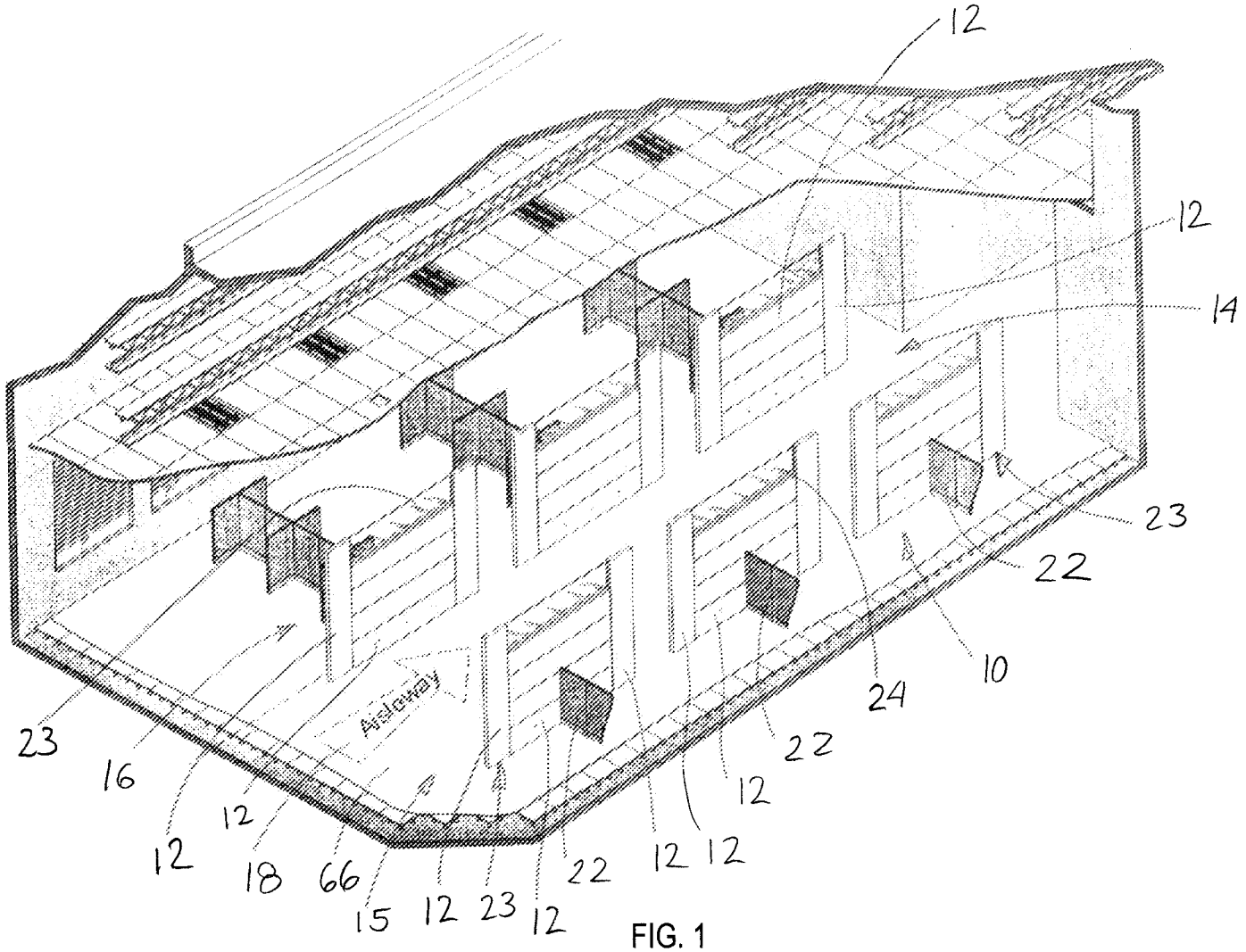
FIG. 1 is perspective view of a building space subdivided with reusable architectural walls of the present invention.

Certain terminology will be used in the following description for convenience in reference only and will not be limiting. The words "up", "down", "right" and left" will designate directions in the drawings to which reference is made. The words "in" and "out" will refer to directions toward and away from, respectively, the geometric center of the device and designated parts thereof. The words "proximal" and "distal" will refer to the orientation of an element with respect to the device. Such terminology will include derivatives and words of similar import.

DETAILED DESCRIPTION

Figure 2:
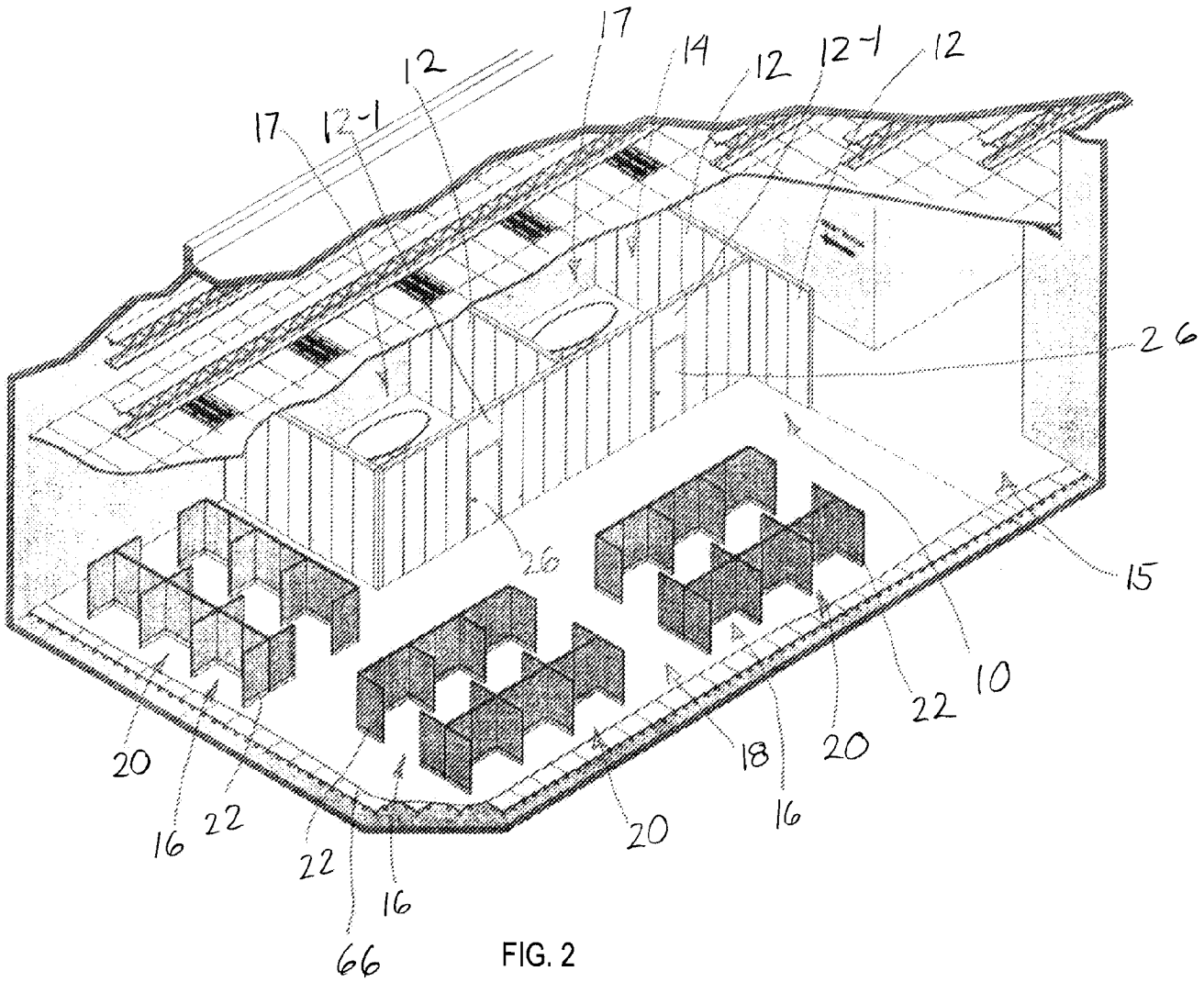
FIG. 2 illustrates a first alternate configuration of the inventive wall system.
Figure 3:
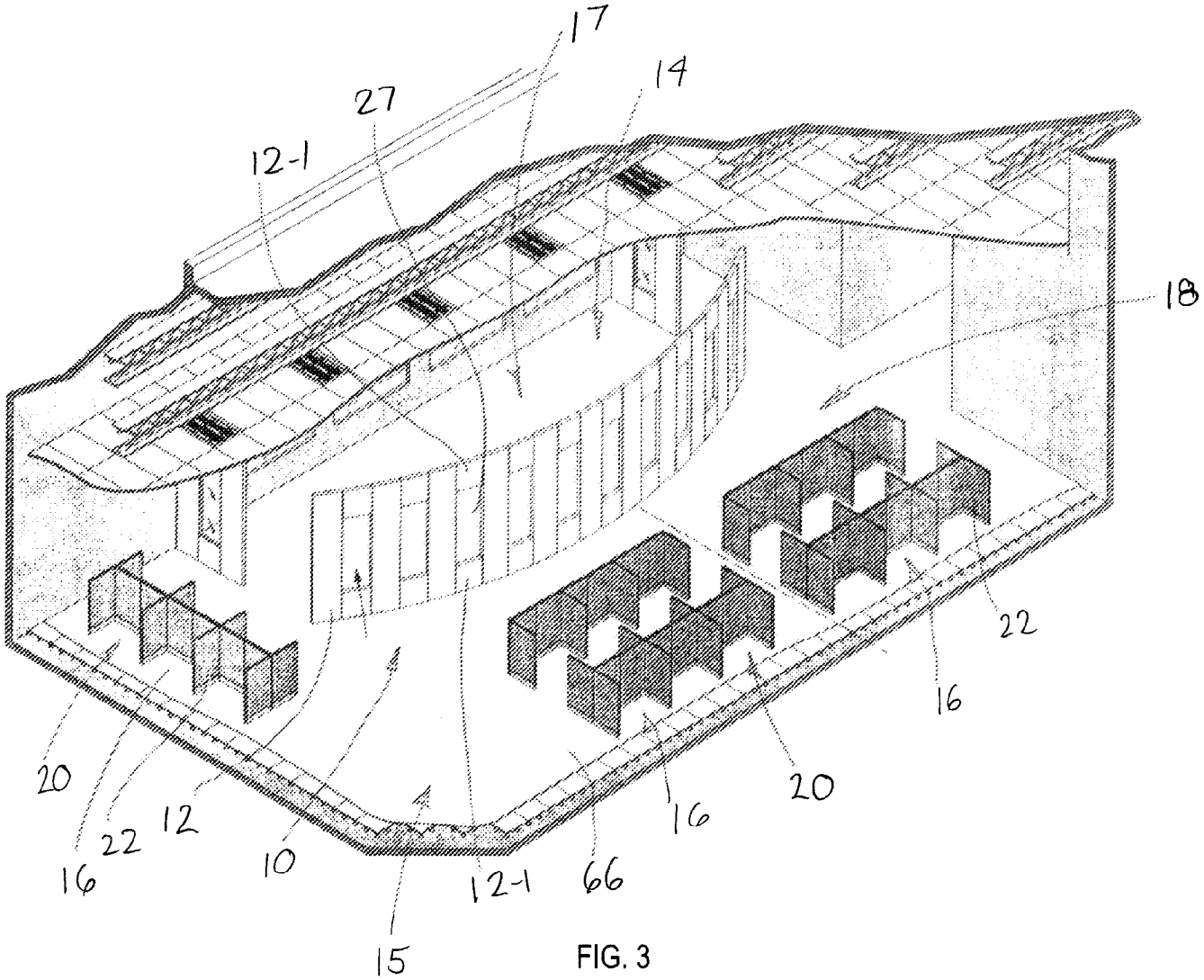
FIG. 3 illustrates a second alternate configuration of the inventive wall system.

Referring to FIGS. 1-3, the invention generally relates to a space-dividing architectural wall system 10, which comprises a plurality of wall panels 12 that can be readily positioned and sized to define a variety of configurations to create individual building spaces or functional spaces 14 in an open building area 15. These building spaces 14 can have a variety of sizes and configurations to define individual work spaces 16, fully or partially enclosed rooms 17, aisle ways 18 and other building features. As can be seen, the size and function of these spaces 16 are readily configurable and modifiable. As will be described further herein, the wall panels 12 also can be provided with a highly acoustic construction with improved acoustic reduction properties, which panels 12 can be mounted to the existing building structure to further improve the acoustic properties of the wall system 10 when separating two different functional spaces.

While the architectural wall system 10 can define individual work spaces 16, the wall system 10 also is usable in combination with conventional space-dividing wall panel systems 20 which typically include a selected number of upstanding wall panel assemblies 22 serially connected, for example, in two-panel straight or angled, or three- or four-panel corner configurations so as to subdivide an office area into the separate work spaces 16.

As to the architectural wall system 10 of the invention, the wall panels 12 of such system 10 are defined by a less-complex construction in comparison with the wall panel systems 20. The wall panels 12 may be constructed of a variety of lengths, and can be configured so as to be oriented both vertically and horizontally as seen in FIG. 1. In FIG. 1, a plurality of wall panels 12 are stacked horizontally one on top of the other, and additional vertical wall panels 12 are connected to the horizontal panels 12 at their opposite ends to define a composite wall structure 23. The horizontal panels 12 are shown with a glass panel 24 mounted to the top thereof. The wall panels 12 therefore preferably define rigid box-like structures that can be stacked one above the other, or oriented vertically and positioned sidewardly adjacent to each other. These fundamental box-like wall structures as defined by wall panels 12 provide the basic building blocks for constructing building walls 23 in a variety of configurations. These wall panels 12 provide substantial flexibility in initially configuring and if desired, reusing the wall panels 12 and tailoring the wall panels 12 to fit specific building areas 15.

In the configuration of FIG. 1, the wall structures 23 are provided in two parallel rows to define the aisle way 18 on one side face thereof, and on the other side face, the wall structures 23 are provided in combination with various wall panel systems 20. In FIG. 2, the wall panels 12 are provided in an alternate configuration wherein the wall panels 12 are oriented to run vertically and are connected to each other in side by side relation. The wall panels 12 in this configuration define the perimeter walls of two rooms 17 and include a doorway 26 topped by a short wall panel 12-1. In FIG. 3, a further configuration is provided wherein a plurality of full-height, vertically-oriented wall panels 12 are provided in combination with vertically-spaced, short wall panels 12-1 to define windows or openings 27 vertically therebetween. Preferably, the window openings 27 are filled with a suitable glass or glass panel insert. As can be seen, the wall panels 12 of the wall system 10 provide significant flexibility in the orientation and resultant appearance of the wall panels, as well as the configuration of the building spaces 14 defined thereby.

Referring to FIGS. 4 and 5, the wall panels 12 have one construction which uses minimal component parts and common construction materials to provide a cost-effective, adaptable wall construction that can be oriented vertically or horizontally. The wall panel 12 comprises a plurality of elongate internal support rails 30 and 31, preferably oriented in parallel, and facing panels 33 that are non-removably fastened to the opposite faces of the internal rails 30 and 31 to define a structurally rigid box-like structure. The internal rails 30 and 31 comprise end rails 30 which define opposite side edges of the wall panel 12, and at least one interior rail 30 which is disposed in the middle region of the wall panel 12. The internal rails 30 and 31 maintain the facing panels 33 in spaced relation and at least the end rails 30 and facing panels 33 are fixed together to define the rigid wall panel 12. In this regard, the opposing faces of the end rails 30 and facing panels 33 abut against each other and are affixed together such as by a suitable adhesive. The interior rail 31 is provided within the hollow interior or the panel cavity 34 of the wall panel 12 and maintains the separation between the opposed facing panels 33 to prevent buckling under load and improve the strength of the wall panel 12.

The rails 30 and 31 are oriented in parallel and the facing panels 33 are inherently rigid, particularly when compressed by loads in the face-wise direction. The facing panels 33 in turn are reinforced by the rails 30 and 31 to define a structurally rigid, open-ended tubular structure. Due to the structural rigidity of the facing panels 33 which have substantial strength when subjected to face-wise loads, additional rail structure is not required like conventional wall panels which typically use a rectangular, internal, load-bearing frame. While the facing panels 33 can provide structural support solely by their inherent rigidity, it will also be understood that the facing panels 33 may also comprise additional structural support through the provision of other rigidifying means preferably provided in cooperation with the inside faces of the facing panels 33.

For example as generally seen in FIG. 5, a facing panel 33 may be provided with reinforcement structure such as internal ribs 33-1 or 33-2 on the inside panel faces within the cavities 34 which ribs 33-1 or 33-2 may be attached by bonding or other means to the inside faces wherein one example of such ribs 33-1 or 33-2 could be defined by rails having a v-shaped cross-section which are bonded to the inside panel face. The ribs 33-1 or 33-2 also could be formed integral with the facing panel 33 such as by corrugations or ridges formed in the panel material such as by molding or pressing of the facing panel 33. The ribs 33-1 or 33-2 may extend lengthwise or crosswise such as ribs 33-1 or at angular orientations relative to these directions such as ribs 33-2, or may even be provided so as to extend in two or more of these directions, such as in a grid pattern. Preferably, the reinforcement structure on the facing panels 33 is not fixed to the support rails 30, and preferably has a relatively low profile so as to leave the cavities 34 open within the panel interior to allow for the passage of air, cabling or the like.

As an additional means of providing reinforcement to the facing panels 33, the cavities 34 could be partially or completely filled with a flowable filler material 33-3 such as foam that bonds to the interior cavity faces defined at least by the facing panels 33. FIG. 5 merely represents this foam by reference number 33-3 to indicate that the filler material fills the space 34. The foam 33-3 then hardens and rigidifies the wall panel structure. The foam 33-3 could completely fill a cavity 34 as seen in the left side of the left wall panel 12 of FIG. 7 or could only partially fill a cavity 34 as seen in the right side of the left wall panel 12 of FIG. 7 so that cable or air passages 33-4 are formed in the cavity 34 in combination with the filler material 33-3 which filler material 33-3 bonds between or forms a reinforcing bridge between the facing panels 33 within a cavity 34.

Preferably, the panel cavities 34 of the wall panels 12 essentially are open ended in the lengthwise directions of the support rails 30 and 31, which provides internal access to the panel cavities 34 in the spaces defined laterally between the support rails 30 and 31. The panel cavities 34 therefore have opposite open ends 36 and 37 which allow for the laying of cabling therethrough, wherein the facing panels 33 are formed of machinable construction materials that can be ported or cut such as by available cutting tools. The ports or openings 101, described below, are cut into the facing panels 33 and are then used for mounting of electrical receptacles and the like on the facing panels 33.

With this construction, the facing panels 33 form part of the rigid panel structure in that the support rails 30 and 31 provide a level of strength and rigidity but the facing panels 33 also provide rigidity both lengthwise along the length of the rails 30 and 31 and also crosswise or laterally relative thereto. The facing panels 33 preferably are bonded at least to the end support rails 30 and 31 to unitize and rigidify the panel structure so that the facing panels 33 provide load-bearing support to the wall panel 12. Notably, the inherent rigidity of the facing panels 33 is reinforced by the bonding to the support rails 30 which therefore allows a particular wall panel 12 to be oriented both vertically, wherein the support rails 30 and 31 extend vertically, or horizontally, wherein the support rails 30 and 31 extend horizontally. When oriented horizontally, the face-wise rigidity of the facing panels 33 carries vertical loads independent of the support rails 30 and 31 which extend horizontally and therefore do not carry the vertical loads. In this instance, the support rails 30 and 31 would structurally support the facing panels 33 by preventing bowing or buckling of the facing panel 33 under vertical load since at least the support rails 30 are bonded to the opposite facing panels 33 and maintain same in parallel, planar orientations relative to each other. As described above, however, these cavities 34 and the facing panels 33 also may be provided with supplemental reinforcement structure such as patterns of ribs 33-1 or 33-2 or filler material 33-3.

For aesthetics, the facing panels 33 preferably have a cover sheet 40 of any suitable material affixed thereto to define the finished appearance of the panel side face 41. The cover sheet 40 may be any suitable material such as fabric or vinyl, or a paintable surface material, which materials can be selected based upon such aesthetic characteristics as color, pattern, weave, etc.

Preferably, the facing sheets 33 are formed of readily available and typically inexpensive sheets of known architectural or construction materials such as gypsum board, R-board, particle board, mineral board, and cement fiber board. This allows for the use of readily-available construction materials which can be selected based upon such structural characteristics as strength, thickness and sound dampening and transmission characteristics.

Preferably, the total thickness T (FIG. 5) of the wall panels 12 is about 4.5 inches which is a standard wall thickness, wherein the facing sheets 33 preferably have a thickness of 0.5 inches. Hence, the material selected for the facing sheets 33 can be varied since many construction materials can be found with a thickness of 0.5 inches.

Figure 6:
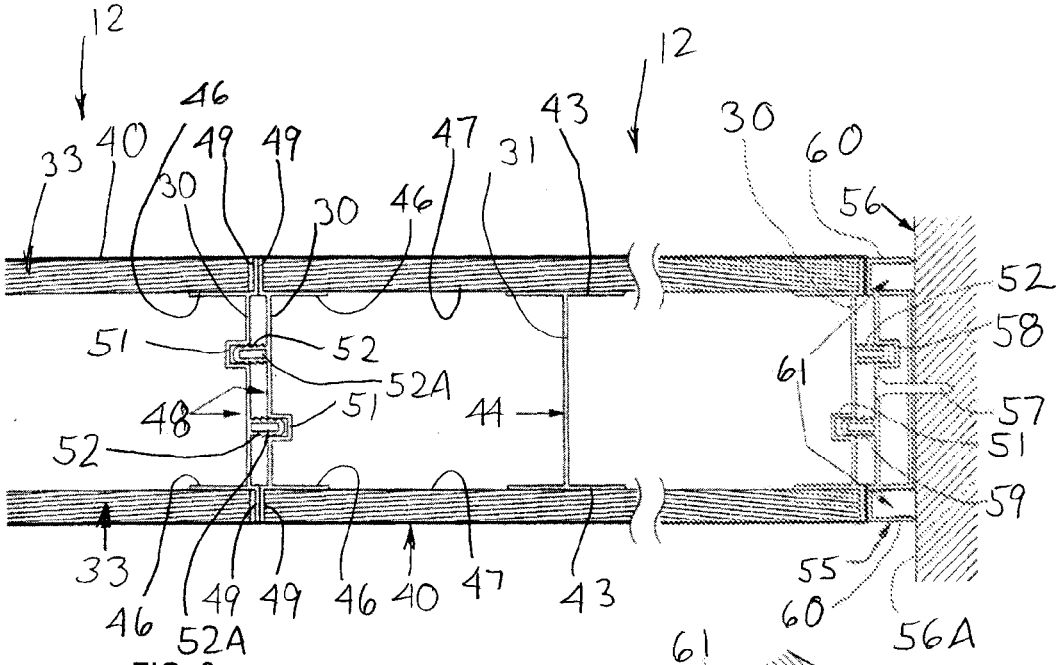
FIG. 6 is a top view of the wall panel.

Referring next to FIG. 6, the end support rails 30 preferably are formed of extruded, structurally rigid metal such as aluminum, while the interior support rail 31 may be formed of metal or plastic studs. More particularly, the interior support rail 31 has an H-shape defined by opposite side flanges 43 which are joined together by a cross web 44.

The support rails 30 at the opposite side edges of the facing panels 33 also have a preferred profile which forms structurally rigid joints between two serially-adjacent wall panels 12. In this first embodiment, the edge-located end support rails 30 are configured to provide an interfitting, self aligning construction with no separate or loose fasteners. In particular, the end support rails 30 have a pair of side flanges 46 which abut against and are rigidly affixed to an inside face 47 of the facing panel 33. The side flanges 46 are joined together by a rail end wall 48 and also turn outwardly to define an edge flange 49 that protects the side edge of the facing panel 33. To provide rigidity to the joint between two serially-adjacent wall panels 12, the rail end wall 48 includes a groove 51 and rib 52 which are parallel to each other and complementary to the groove 51 and rib 52 on the adjacent wall panel 12 so that the aligned grooves 51 and ribs 52 mate with each other, which thereby mates the panels 12 together and provides a uniform joint between the two panels 12.

Also as to FIG. 6, a wall mount rail 55 is shown which is configured to mount to the face 56A of a building structure such as the structural wall 56 of the building. The wall mount rail 55 is mounted by fasteners 57 to the wall 56 and includes a groove 58 and rib 59 that are complementary to and mate with the groove 51 and rib 52 of an adjacent wall panel 12. The wall mount rail 55 extends vertically along the wall for the height of the wall panel 12 and includes two side-opening channels 60 which each receive a strip of gasket material forming a vertical acoustic seal 61. The seals 61 effectively block any air gaps and prevent sound transmission therethrough. After mounting, the first wall panel 12 is moved sidewardly as indicated by arrow 63A into mating engagement with the wall mount rail 55 and then any subsequent wall panel 12 is moved into mating engagement with the other wall panel 12 as indicated by reference arrow 63B.

Figure 7:
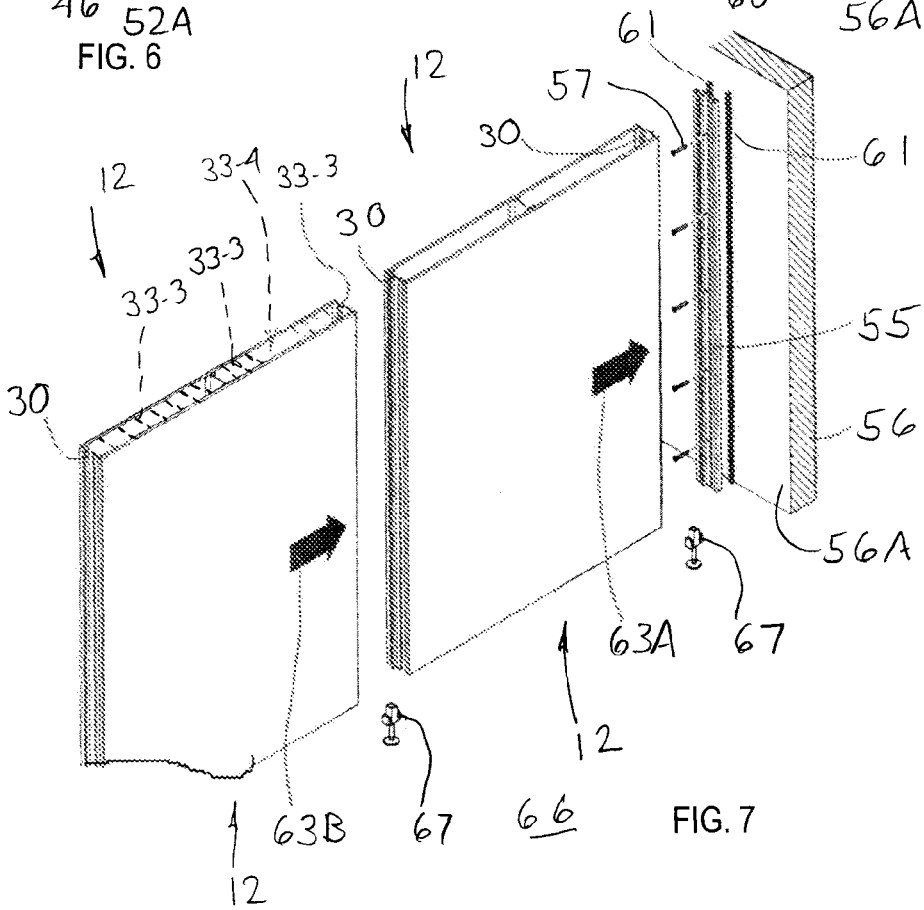
FIG. 7 is an exploded perspective view of a plurality of wall panels being mounted to a wall.
Figure 9:
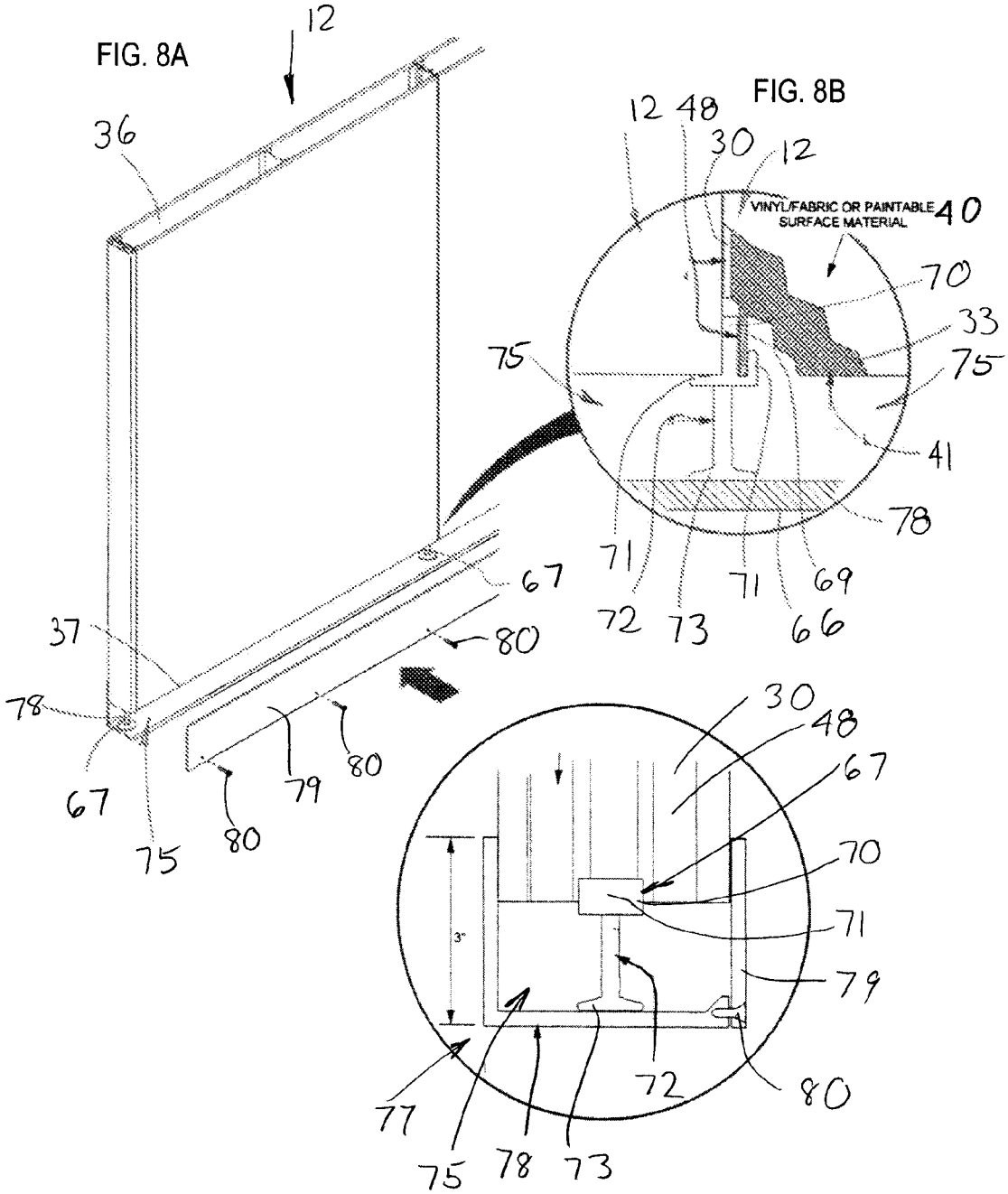
FIG. 9 is an enlarged end view of the base of the wall panel supported in a base or floor channel.

While the wall panels 12 may be supported directly on the floor 66, the opposite ends of the wall panels 12 may be supported on a glide assembly 67 (FIG. 7). More particularly, FIGS. 8A, 8B and 9 illustrate a glide assembly 67 used to support the lower ends 37 of the wall panels 12 in vertically raised relation to the floor 66. To engage the glide assembly 67, the side wall 48 of the end rail 30 may include an indented notch 69 (FIG. 8B) which receives the main body 70 of the glide assembly 67, which body 68 includes two support flanges 71 on opposite sides for engaging a respective notch 49 and supporting a respective end rail 30 thereon. The main body 70 is supported on a glide stem 72 and foot 73, such that the wall panels 12 in this embodiment are vertically raised and define a horizontal channel 75 which may serve as a raceway between the wall panel 12 and floor 66.

To secure the bottom panel edge, the wall system 10 preferably includes a floor-mounted channel 77 which is generally U-shaped and receives the glide assemblies 67 and bottom panel edge therein. The channel 77 comprises an L-shaped channel body 78 and a removable channel wall 79 which is fastened to the channel body 78 by fasteners 80 (FIG. 9). Hence, the bottom end of the wall panel 12 can be slid sidewardly into the open side of the channel 77 which channel 77 is then closed by installation of the channel wall 79.

Figure 10:
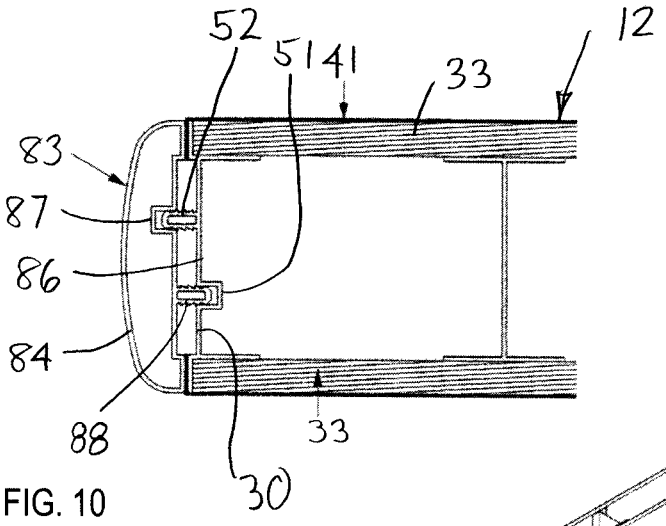
FIG. 10 is top view of one end of a wall panel with a trim cover.
Figure 11:
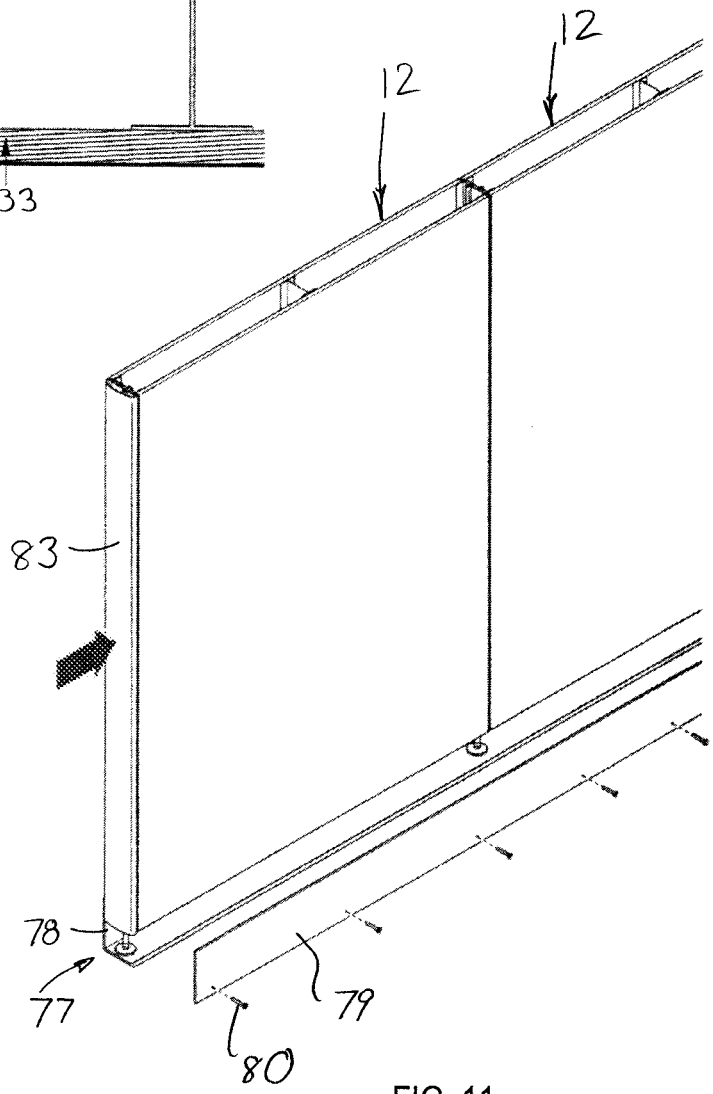
FIG. 11 is perspective view of an end-of-run location at the end of a plurality of wall panels.

In this manner, a row of wall panels 12 can be installed together in series. At the end of a series of such wall panels 12, an end cap 83 is provided as seen in FIGS. 10 and 11. The end cap 83 has an arcuate outer wall 84 and a flat inner cap wall 86 which includes a groove 87 and a rib 88. The groove 87 and rib 88 are complementary to the groove 51 and rib 52 of the end rail 30 of the wall panel 12, which therefore allows for interfitting engagement of the grooves and ribs to each other and secures the end cap 83 to the endmost wall panel 12.

Figure 12:
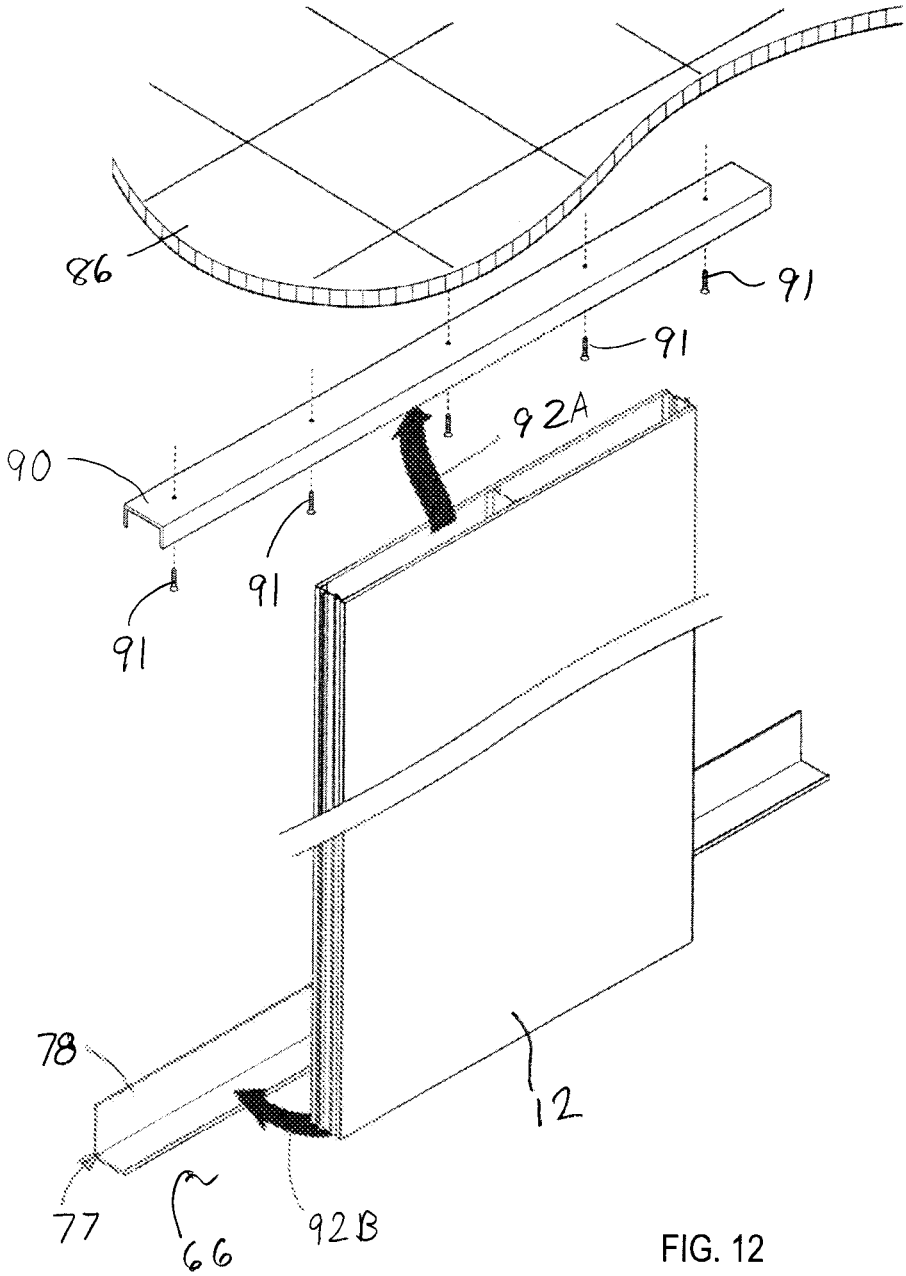
FIG. 12 illustrates installation of a wall panel in top and bottom channels.

Referring to FIG. 12, the wall panels 12 can be mounted so as to extend completely from floor 66 to ceiling 86. For the floor 66, the above-described floor channel 77 is provided with the channel body 78 being shown in FIG. 12. At the top, a ceiling channel 90 is mounted to the ceiling by fasteners 91. This ceiling channel 90 preferably has a U-shaped, but fixed construction which receives the top edge of the wall panel 12 by shifting the wall panel 12 sidewardly and then upwardly as indicated by arrow 92A. Thereafter, the bottom wall panel edge is swung inwardly into the channel body 78, which thereafter would be closed off by the channel wall 79 (not shown in FIG. 12). By hiding the top and bottom edges of the wall panels 12 within these channels 77 and 90, the top and bottom wall panel edges do not need to be aligned precisely but can be offset. For example, the floor 66 may not be completely level due to variations during pouring of concrete floors or other surface variations. This may cause the top and bottom edges of one wall panel 12 to be higher or lower than an adjacent wall panel 12. Rather than attempt to level the top and bottom edges precisely, the wall panel edges are hidden instead by the channels 77 and 90.

Referring to FIGS. 13 and 14, the wall panels 12 also may be shorter than ceiling height so as to terminate at most any height. In this regard, the wall panels 12 as described above are formed of materials which may be cut to length in the field by suitable tools. For example, the wall panels 12 could be provided in a variety of lengths ranging between 36.0 inches to 120.0 inches. This allows the wall panels 12 to be installed floor to ceiling, and yet if the wall panels 12 are provided only in standardized lengths of 10 feet and 12 feet, the wall panels 12 can fit any room height between these modular lengths, such as 11 feet 2 inches, simply by cutting the wall panels to the proper length. In this regard, a cut is made along either of the open ends 36 or 37 so that the structural strength of the wall panel 12 is not impacted.

If the wall panels 12 will only extend part way to the ceiling, a standard height panel, such as an 8 foot panel might be selected. However, a standard height panel might also be cut to a desired non-modular height, such as, for example, 7 feet 3 inches. These dimensions are only cited for illustrative purposes and virtually any panel height might be selected for a wall panel oriented vertically. Since the wall panels 12 can also be oriented horizontally, the horizontal length of the wall also might be adjusted by cutting the wall panels 12 to length and then positioning the wall panels 12 in the horizontal orientation.

For a vertically oriented wall panel 12 as seen in FIGS. 13 and 14, the wall panels 12 are capped by a top cap 95 which mounts to a cap rail 96. The cap rail 96 is an extrusion that is affixed to the wall panels 12 by fasteners 97. The fasteners 97 thread downwardly into the open ends 52A (FIG. 6) of the ribs 52, which serve as fastener bores so that the threads of the fasteners 97 bite into the inside faces of the ribs 52. The fasteners 97 are staggered along the length of the cap rail 96 so as to engage the fastener bores formed in the support rails of the wall panels 12. The cap rail 96 includes side mounting channels 98 which can be used to support functional components thereon. The top cap 95 is removably mounted to the cap rail 96 as seen in FIG. 14.

Figure 15:
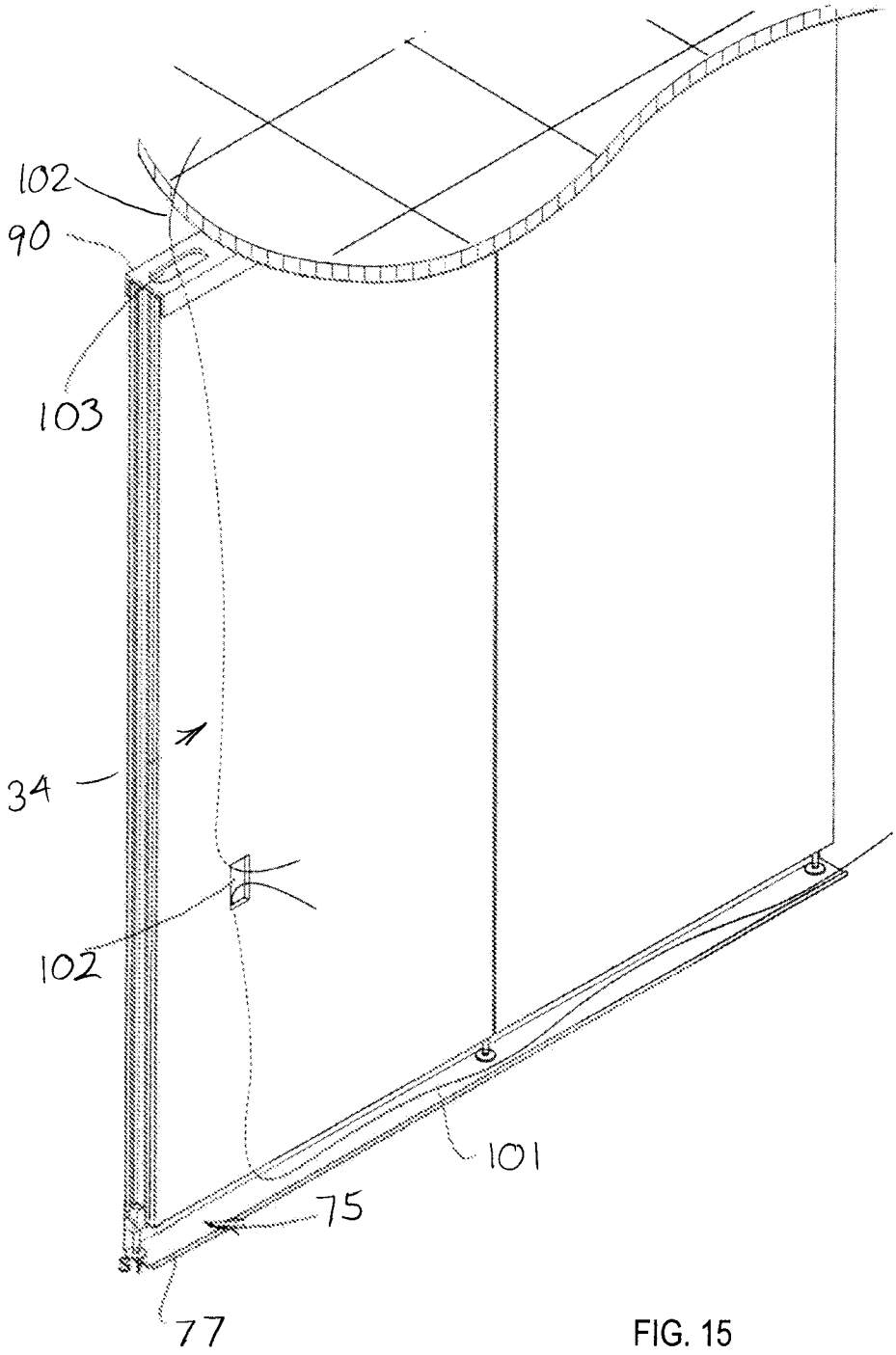
FIG. 15 illustrates cabling being routed through the wall panels.

Referring to FIG. 15, the wall panels 12 have significant cable carrying capacity due to their open cavities 34 and the machinability or cutability of the facing panels 33. As can be seen, various cabling 100 can be routed through the raceway 75 into the cavities 34 and then exit such cavities through a port 101 which has been cut through the facing panel 33. This port 101 can be cut at any desired location such as during field installation. Other cabling 101 can be routed from the ceiling and into the cavities 34 through a cable passage 103 formed in the ceiling channel 90, which cabling 101 is then routed as desired, for example to the port 102. In this manner, the cavities 34 essentially define lengthwise extending cable passages, which can be oriented vertically as seen in FIG. 14 or would extend horizontally if the wall panel 12 is installed in such orientation as seen in FIG. 1.

Figures 16, 17:
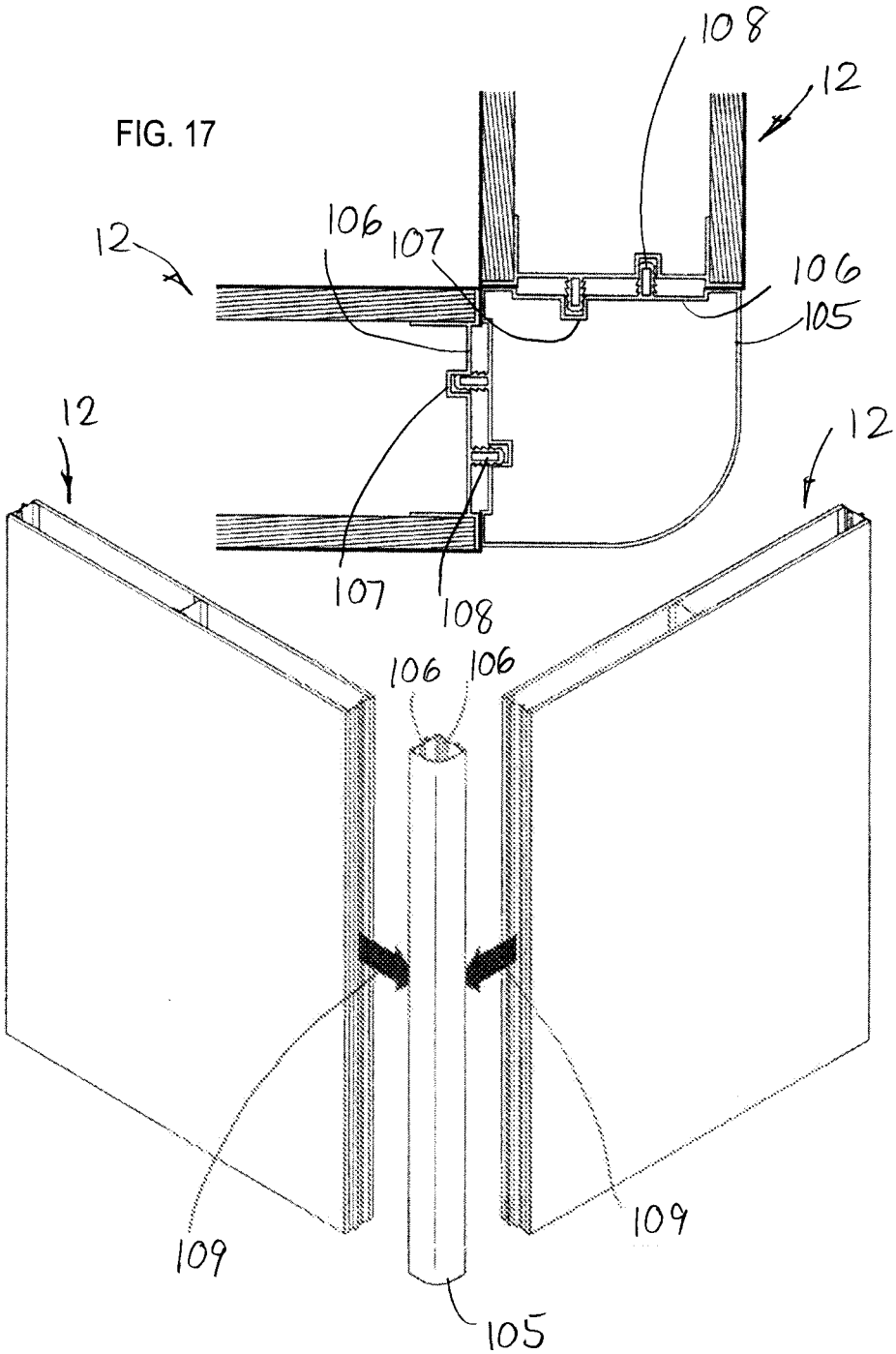
FIG. 16 is an exploded perspective view of a right angle two-way corner.
FIG. 17 is a top view thereof.

If desired, a corner post 105 may be used to define a two-way configuration as seen in FIGS. 16 and 17. This particular post 105 has two post walls 106 which each include a groove 107 and rib 108 for engagement with the complementary groove 51 and rib 52 of two wall panels 12 connected thereto. The wall panels 12 are displaced into mating engagement with the corner post 105 as indicated by reference arrows 109 in FIG. 16.

Figure 18:
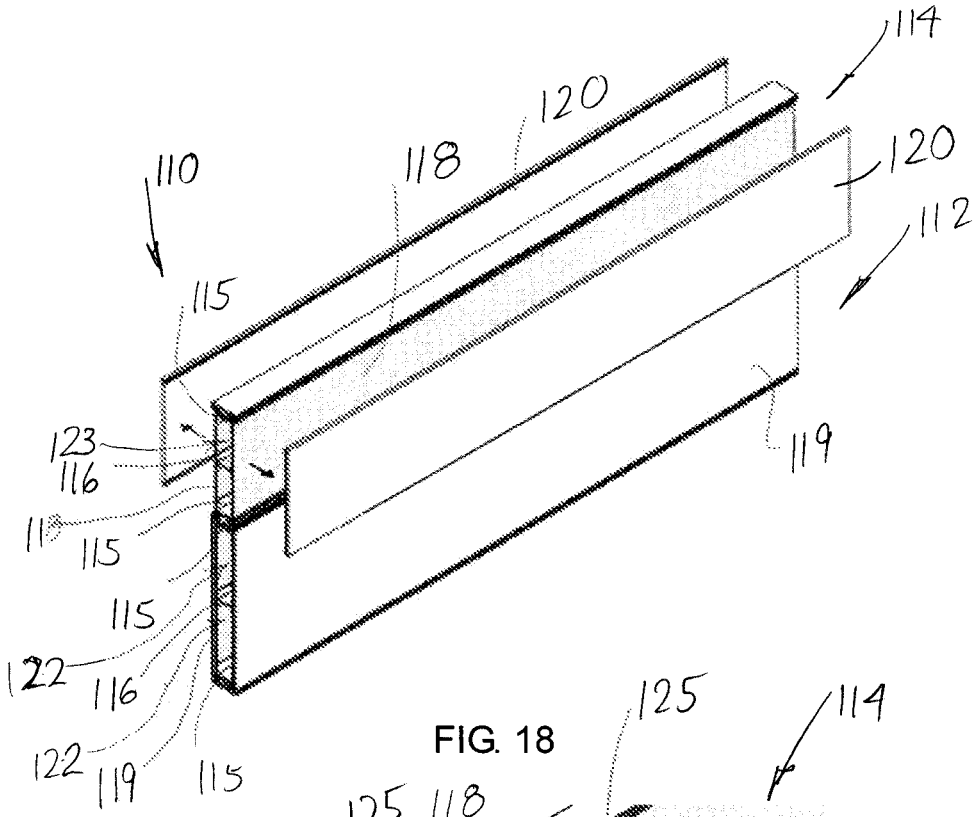
FIG. 18 is a perspective view of a second embodiment of the architectural wall system of the invention showing a wall panel with demountable covers.

Referring to FIGS. 18-40, a second embodiment of the architectural wall system is designated by reference numeral 110. The second embodiment of the architectural wall system 110 includes alternate configurations for the wall panels including a first wall panel 112 and a second wall panel 114. The wall panels 112 and 114 have a similar construction with the primary difference being in the cross-wise or lateral width of the panels 112 and 114. In FIG. 18, the panels 112 and 114 are oriented horizontally and stacked one above the other, wherein the bottom panel 112 has a dimension which might be 24 inches while the top panel 114 has a dimension of 16 inches. Preferably, the panel widths can be 16, 24 and 48 inches which conform to typical construction practices wherein studs may have a spacing of 16 or 24 inches, and many construction materials are dimensioned with 4 or 8 foot widths and lengths. It will be understand these panels and those described hereinafter also may be oriented vertically as shown in FIGS. 1-3 and may support furniture components thereon.

Figure 19:
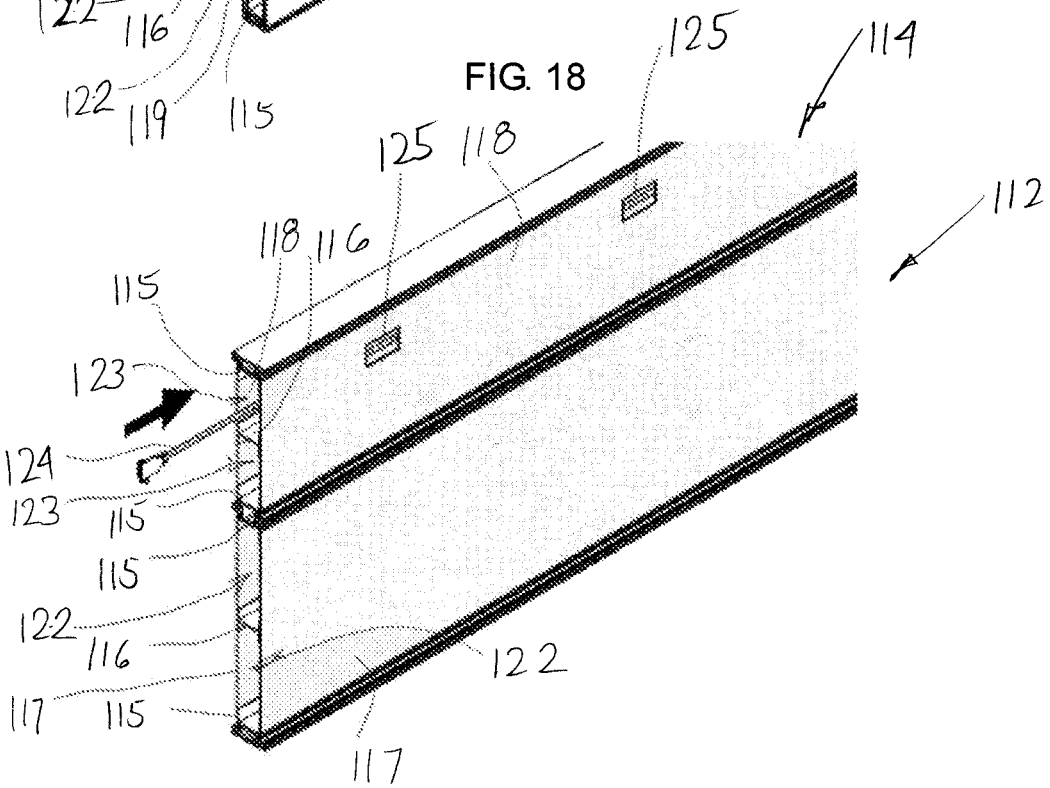
FIG. 19 illustrates a wall panel with cabling passing therethrough.

In the panels 112 and 114 of FIGS. 18 and 19, the panels 112 and 114 are each formed of internal edge-located support rails 115 and intermediate interior support rails 116, which are structurally and functionally similar to rails 30 and 31 described above. In this particular panel construction, the wall panels 112 and 114 are formed with thin facing panels 117 and 118 which serve as thin skins that are fixed at least to the rails 115 to form the rigid tubular panel structure. In this embodiment, the thin facing panels 117 and 118 are in turn covered by panel covers 119 and 120 which overlie the facing panels 117 and 118 and define the exposed surfaces of the wall panels 112 and 114.

The rails 115 and 116 are oriented in parallel and the facing panels 117 and 118 are inherently rigid, particularly when compressed by loads in the face-wise direction. The facing panels 117 and 118 in turn are reinforced by the rails 115 and 116 and further reinforced by the thicker panel covers 119 and 120 to define a structurally rigid, open-ended tubular structure. Due to the structural rigidity of the facing panels 117 and 118 and the overlying panel covers 119 and 120, the wall panels 112 and 114 have substantial strength when subjected to face-wise loads. Here again, however, these facing panels 117 and 118 also may be provided with supplemental reinforcement structure such as patterns of rail-like ribs like ribs 33-1 or 33-2 or a filler material like material 33-3.

Once assembled, the wall panels 112 and 114 define interior panel cavities 122 and 123 through which cabling 124 may be routed as seen in FIG. 19. If desired, the facing panels 117 and 118 may be ported to define ports 125 as mentioned previously to accommodate electrical receptacles, switches and other electrical fixtures.

Referring to FIGS. 20A and 20B, the wall panels 112 and 114 are shown connected together to define a wall structure comprising the two top and bottom panels stacked together in two rows. It will be understand that additional rows of wall panels can be stacked one above the other to define a higher wall structure. To join the panels 112 and 114 along their adjacent horizontal edge rails 115, an extruded connection key 130 is provided which locks into each of the edge rails 115. The wall structure also can include a cap rail 131 and a bottom floor rail 132 which includes glides 133 for supporting the wall panel 112 on the floor.

Referring more particularly to the key connection between the two stacked panels 112 and 114, the key 130 is formed as a tubular extrusion having corner flanges 135 which project sidewardly a short distance. As described below, these corner flanges 135 snap lockingly engage the edge rails 115 when joining two wall panels 112 and 114 together. In the preferred form of the invention, adjacent wall panels 112 and 114 could be locked together at their side edges solely by displacement of one wall panel toward the other which thereby engages the key 130 between the two wall panels. As such, the wall panels 112 and 114 can be connected directly together along their longitudinal side edges in a variety of configurations. For example, the wall panels 112 and 114 can be configured so as to extend floor-to-ceiling or terminate at shorter heights below the ceiling. This is true whether the wall panels 112 and 114 are oriented horizontally as shown or oriented vertically as shown in FIGS. 1-3. As such, the wall panels 112 and 114 can be stacked together when oriented horizontally, or positioned side-by-side when oriented vertically, or joined together in combinations of horizontal and vertical orientations with the key 130 providing quick engagement of adjacent wall panels together. The horizontally stacked wall panels and their edge-connecting support rails 115 allow for wall runs of panels 112 and 114 having substantial lengths while minimizing the necessity of perpendicular support structures such as return walls, building posts or the like along these wall runs. These wall runs preferably can span 24 feet between the supports. The edge rails 115 comprise a main rail body 137 which is formed with side flanges 138 that are bonded to the facing panels 117 or 118. The side flanges 138 join to a pair of channel sides 139 which define an edge channel 140 along the length of the wall panel 112 or 114. The side flanges 138 also include a respective hook 141 for snap fitting engagement with a cover panel 119 or 120 as will be described further herein.

The main rail body 137 is bonded with an extruded liner 145 which lines the interior surface of the edge channel 140 and includes a pair of cantilevered, resiliently deflectable catches 146. The catches 146 deflect upon contact with the corner flanges 135 of the key 130 and then snap back to abut against the corner flanges 135 and thereby secure the key 130 to the respective wall panel 112 and 114. Upon engagement of the key 130 with both of the wall panels 112 and 114, these wall panels 112 and 114 are fixedly secured together along their contiguous panel edges. While the key 130 is provided as a separate rail-like structure, the structures of the key 130 may be integrated into at least one of the panels 112 or 114, for example, as an integrated, non-removable panel feature.

To support storage and work components on the wall panels 112 and 114, the wall panel system 110 also includes an off-modular mounting rail 150 which may optionally be fixed in a gap formed between the cover panels 119 and 120 as seen in FIG. 20B. The mounting rail 150 includes ribs 151 which are configured to snap into corresponding slots 152 formed in the rail liner 145. In this manner, the mounting rail 150 is pushed into the gap or joint between the two wall panels 112 and 114 until the ribs 151 snap into the slots 152. The mounting rail 150 defines a mounting slot 153 which opens sidewardly to receive connectors or hooks of various types of functional components. As such, the mounting rails 150 allow for the connection of various furniture components thereto in both modular and off-modular locations along the length of a wall panel. It will be understood that the connectors or hooks can be configured to engage the mounting slot 153 when oriented either horizontally or vertically. In this regard, the mounting rail 150 could be provided with a row of spaced apart support slots or apertures extending along the length of the rail within the interior of the mounting slot 153. As such, the row of support slots can be oriented both vertically and horizontally depending upon the corresponding orientation of the mounting rail 150.

Figures 21A, 21B:
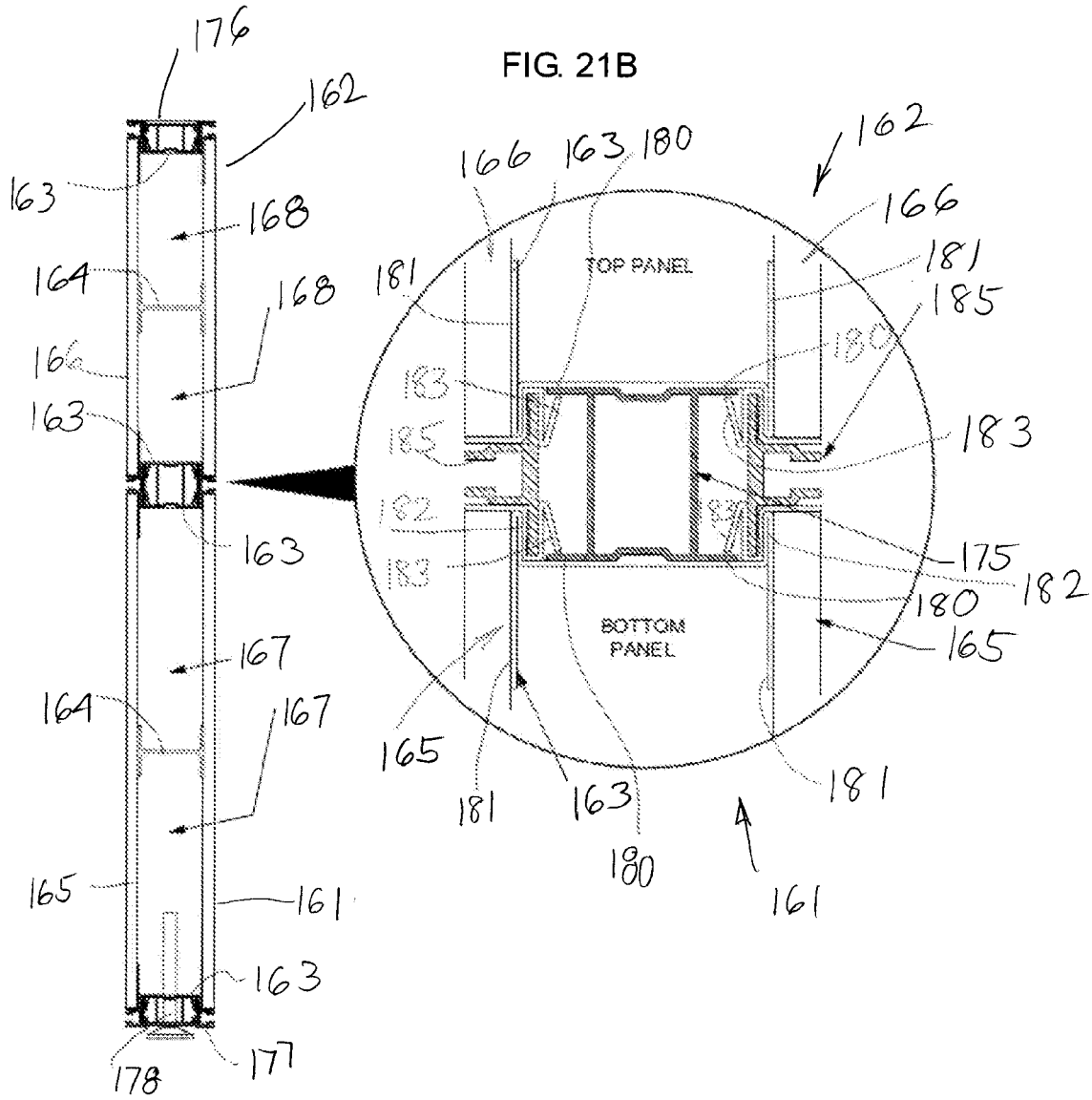
FIG. 21A is an end view of a wall panel having a fixed skin.
FIG. 21B is an enlarged partial view of the wall panel of FIG. 21A.

Referring to FIGS. 21A and 21B, an alternate wall panel construction is shown by wall panels 160 and 161. In these wall panels 161 and 162, the same basic components are provided, wherein the panels 161 are each formed of internal edge-located support rails 163 and intermediate interior support rails 164, which are structurally and functionally similar to rails 30/31 and 115/116 described above. In this particular panel construction, the wall panels 161 and 162 are formed as full thickness facing panels 165 and 166 which are fixed at least to the rails 163 to form the rigid tubular panel structure.

The rails 160 and 161 are oriented in parallel and the facing panels 165 and 166 themselves are inherently rigid, particularly when compressed by loads in the face-wise direction. Due to the structural rigidity of the facing panels 165 and 166, the wall panels 112 and 114 have substantial strength when subjected to face-wise loads.

Figure 35:
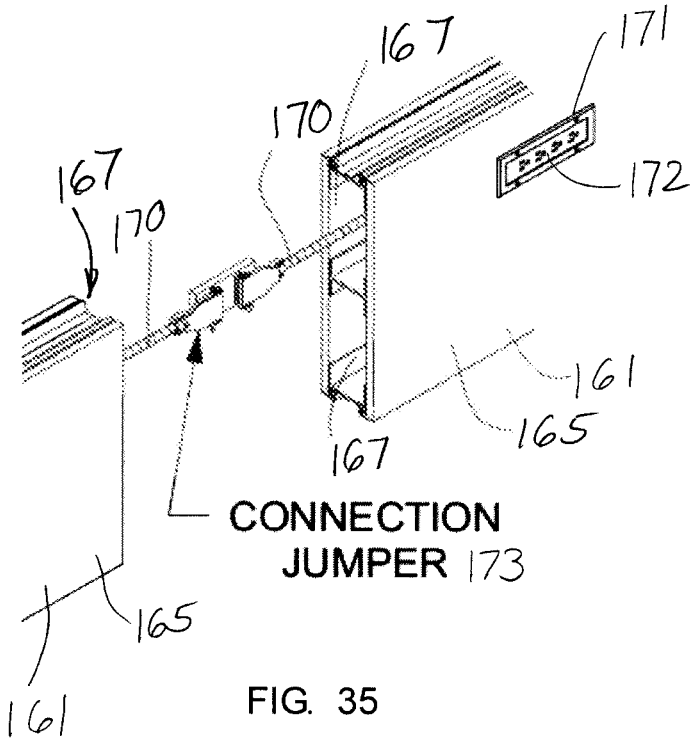
FIG. 35 is a partial perspective view of interconnected electrical cables extending between two wall panels.

Once assembled as seen in FIG. 35, the wall panels 161 and 162 define the interior panel cavities 167 and 168 through which cabling 170 may be routed. If desired, the facing panels 165 or 166 may be ported to define ports 171 like those mentioned previously to accommodate electrical receptacles, switches and other electrical fixtures 172 (FIG. 35). If desired, separate cabling 170 can be joined together by a connection jumper 173, and then stored together within the wall panels 167 or 168. When laid horizontally, the wall panels 161 preferably abut against each other at adjacent ends to define a butt joint.

Figure 22:
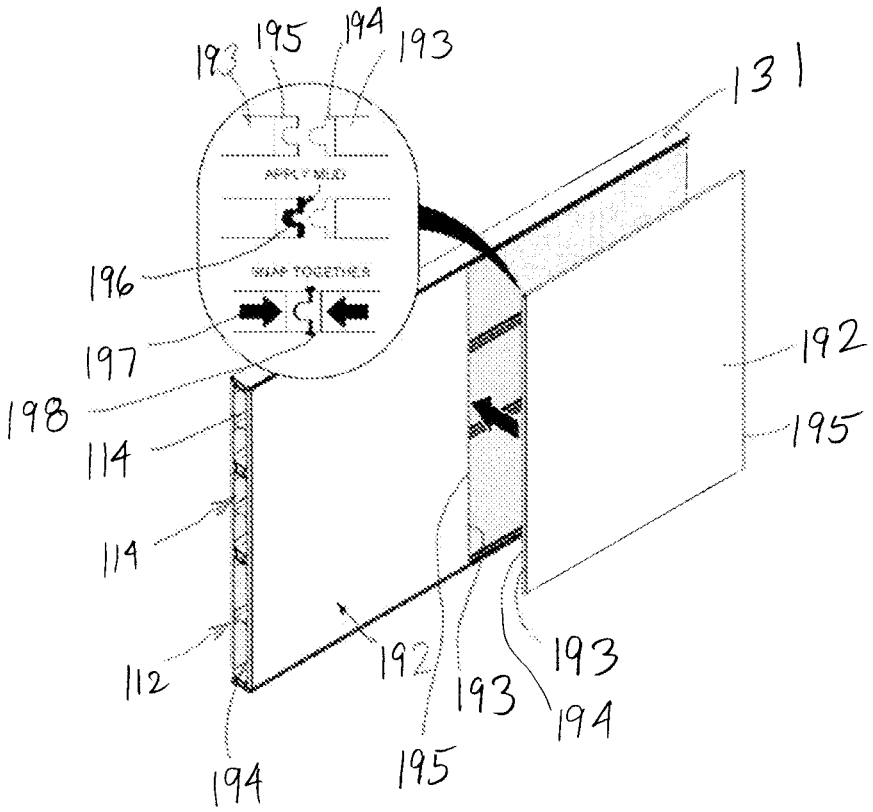
FIG. 22 illustrates the mounting of prefinished covers.

Referring again to FIGS. 21A and 21B as well as FIG. 22, the wall panels 161 and 162 are shown connected together to define a wall structure comprising the two top and bottom panels stacked together in two rows. To join the panels 161 and 162 along their adjacent horizontal edge rails 163, an extruded connection key 175 is provided which locks into each of the edge rails 163. The wall structure also can include a cap rail 176 and a bottom floor rail 177 which includes glides 178 for supporting the wall panel 161 on the floor.

Referring more particularly to the key connection between the two stacked panels 161 and 162, the connection key 175 is formed as a tubular extrusion having corner flanges 180 which project sidewardly a short distance.

The edge rails 163 are formed with side flanges 181 that are bonded to the facing panels 165 and 166. The side flanges 181 join to a pair of channel sides 182 which define an edge channel along the length of the wall panel 161 and 162.

The edge rail 163 includes a pair of cantilevered, resiliently deflectable catches 183, which deflect upon contact with the corner locking flanges 180 of the key 175 and then snap back to abut against the corner flanges 180 and thereby secure the key 175 to the respective wall panel 161 and 162. Upon engagement of the key 175, the wall panels 161 and 162 are fixedly secured together along their contiguous panel edges.

Figure 21C:
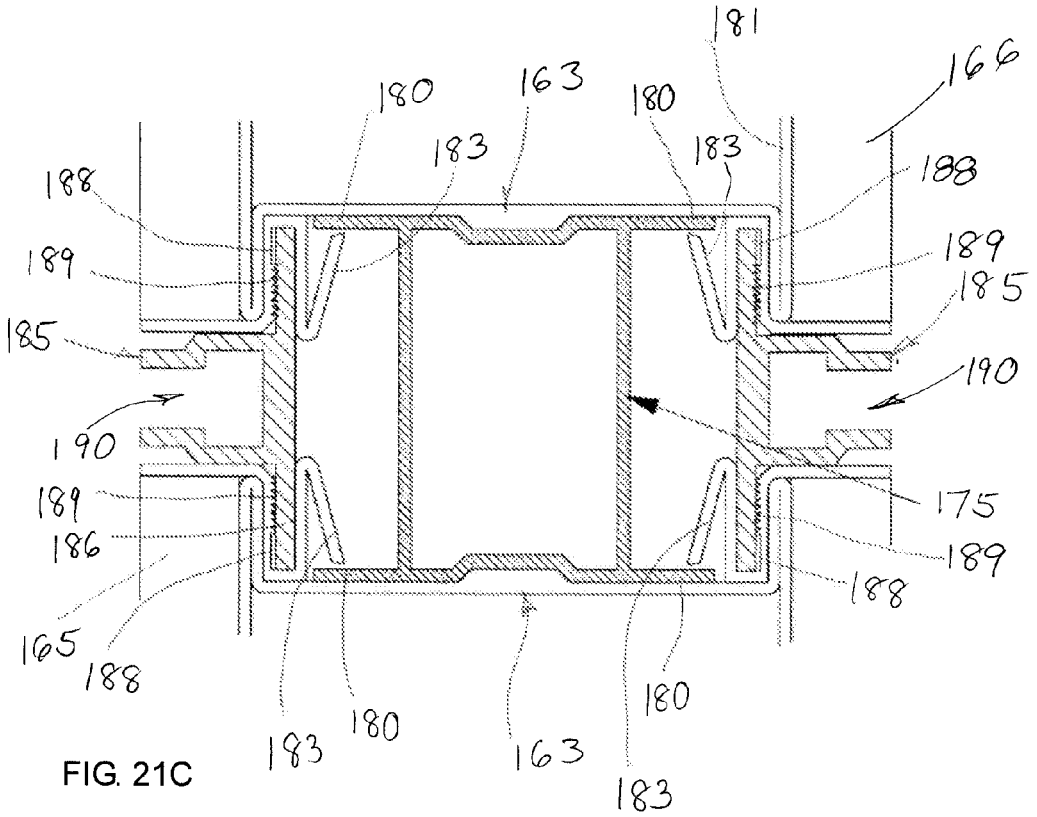
FIG. 21C is an enlarged end view of the connector joint between two wall panels.

Referring in greater detail to FIG. 21C, any storage and work components can be mounted on the interconnected wall panels 161 and 162 by an off-modular mounting rail 185 which may optionally be fixed in a gap formed between the cover panels 161 and 162. The mounting rail 185 includes ribs 186 which are vertically enlarged and configured to tight-fittingly insert within slots 188 formed along the edge channel 163 as best seen in FIG. 21C. At least one interior side face of each slot 188 includes serrations 189 which resist withdrawal of the ribs 186 from the slots 188. The mounting rail 185 would be positioned with its associated ribs 186 near the slots 188 and then the ribs 186 are slid into the slots 188 during joining of the wall panels 161 and 162 together.

Therefore, while the mounting rail 150 can be pushed into the gap or joint between the two wall panels 112 and 114 during or after assembly, the mounting rail 185 would be installed during assembly. Since the facing panels 165 and 166 are fixed in place, there is no need for the mounting rail 185 to be removable or be installed after assembly. Thus, the mounting rails 150 and 185 can have this different construction. Similar to each other, however, the mounting rail 185 defines a mounting slot 190 which has a narrowed mouth that opens sidewardly to receive connectors or hooks of various types of functional components, such as storage cabinets, shelves and the like.

While the wall panels 161 and 162 have the fixed facing panels 165 and 166, the wall panels 112 and 114 have greater flexibility in finishing options. Referring to FIG. 22, these wall panels 112 and 114 may have the cover panels 119 and 120 replaced with alternate cover panels, such as an enlarged, full-height panel 192 which extends the full height of the stacked panels 112 and 114 in FIG. 22. As such, the cover panel 192 spans the vertical height of a bottom wall panel 112 and two rows of wall panels 114.

While the cover panel 192 could have perimeter edges 193 that are finished and simply abut against each other, the edges 193 also could be shaped or provided with edge strips 194 and 195 that may have a complementary male and female shape such as the tongue and groove profile seen in FIG. 22. In some cases, the cover panels 192 may be conventional construction sheets already formed with tongue and groove edge formations. During installation of the cover panels 192, the complementary edges 194 and 195 will be mated together. If desired, an adhesive or a joint compound, such as drywall mud, 196 might be applied to the joint between the edges 194 and 195, and the edges 194 and 195 are then abutted together as indicated by reference arrows 197. The joint 198 may then be troweled flat by an appropriate tool. If desired, the joint 198 may be finished using conventional drywall finishing techniques which involve the application of a joint compound to the exterior faces of the cover panels 192 which is feathered and sanded flat for subsequent finishing such as by painting.

Figure 23:
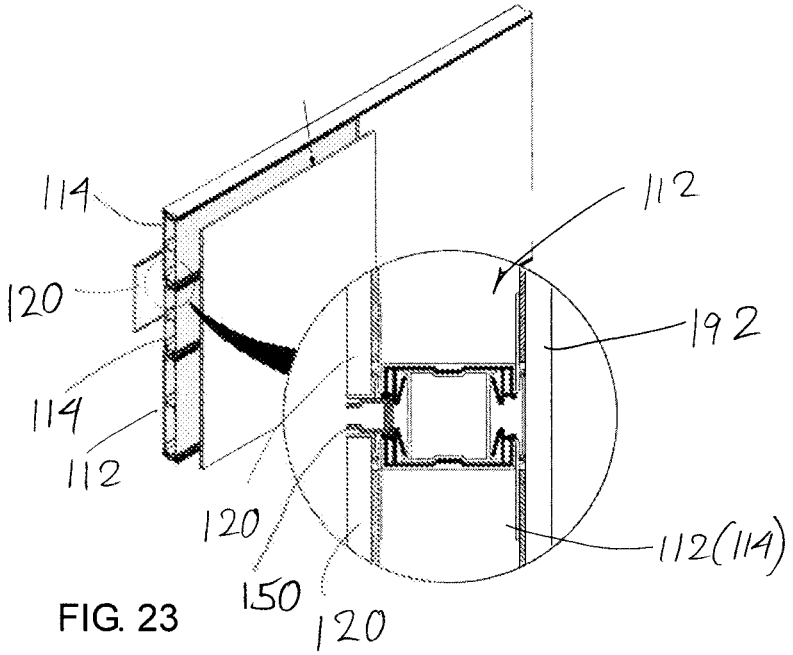
FIG. 23 illustrates an alternate configuration of wall panels in the wall system.

Referring to FIG. 23, the full-height cover panels 192 can be applied to one side of the wall structure defined by wall panels 112 and 114. On the opposite side of the wall panels 112 and 114, the shorter size covers 120 are provided which allows for the installation of the mounting rail 150 on this opposite side as seen in more detail in FIGS. 31 and 32.

Figure 32:
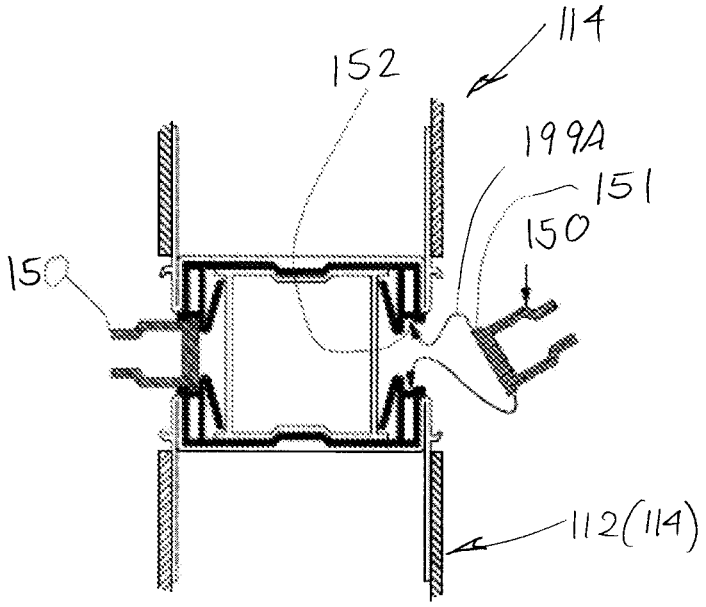
FIG. 32 is an end cross-sectional view of FIG. 31.

In this regard, the mounting rails 150 can be fitted into the horizontal gap defined between two vertically adjacent wall panels 112 or 114. To install the mounting rails 150, the mounting rail 150 is rotated as seen in FIG. 32 to allow the top rib 151 to be fit into the corresponding slot 152 as indicated by reference arrow 199A. Thereafter, the mounting rail 150 is rotated to snap the bottom rib 151 into its corresponding slot 152 formed in the second rail extrusion 145. In this manner, the mounting rail 150 is pushed into the gap or joint between the two wall panels 112 and 114 until the ribs 151 snap into the slots 152.

Figure 33:
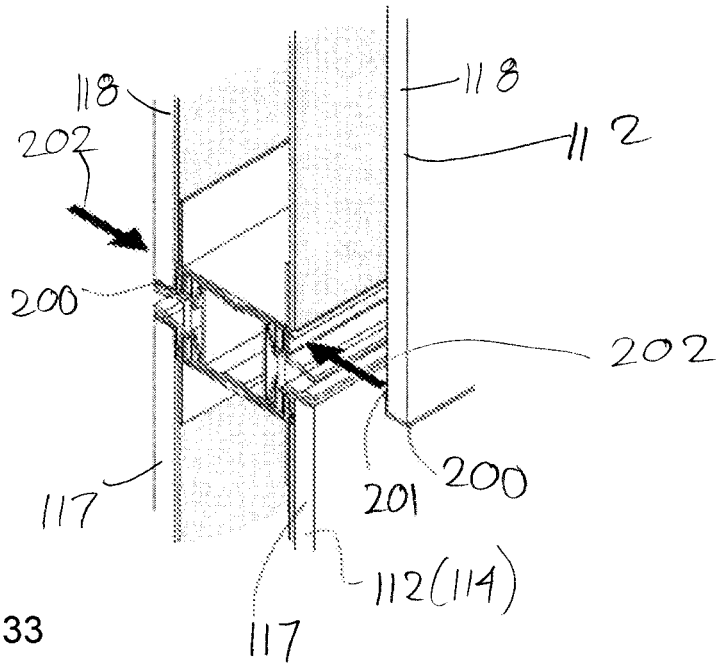
FIG. 33 is an exploded perspective view showing cover panels being installed.
Figure 34:
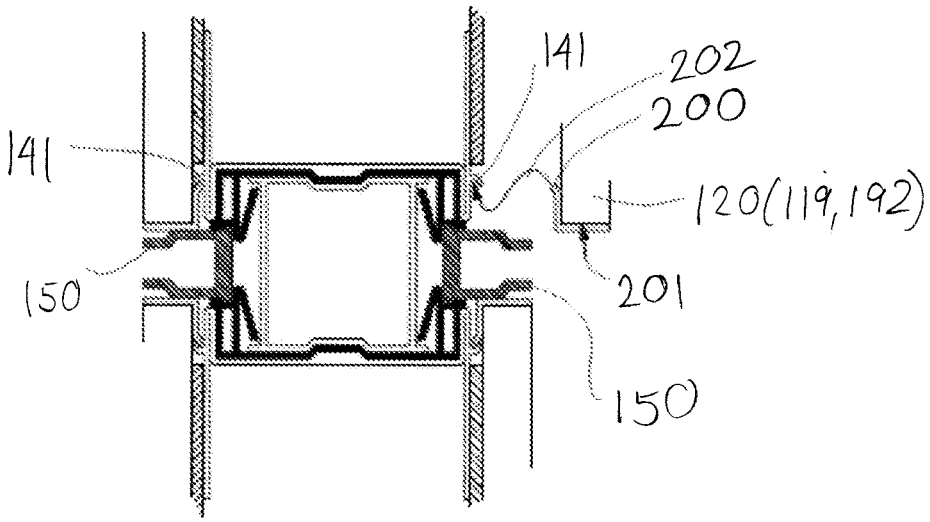
FIG. 34 is an end cross-sectional view of FIG. 33.

As to the cover panels 192 on the one side, the cover panels 192 are mounted using the hooks 141 described above which are engaged with corresponding hooks 200 (FIGS. 33 and 34) that are formed by L-shaped edge strips 201, which strips 201 are applied to the top and bottom edges of any of the cover panels 119, 120 or 192. Similarly, the cover panels 119 and 120 also mount in the same manner as best seen in FIGS. 33 and 34. These hooks 200 snap over the hooks 141 as indicated by reference arrows 202.

Figure 24:
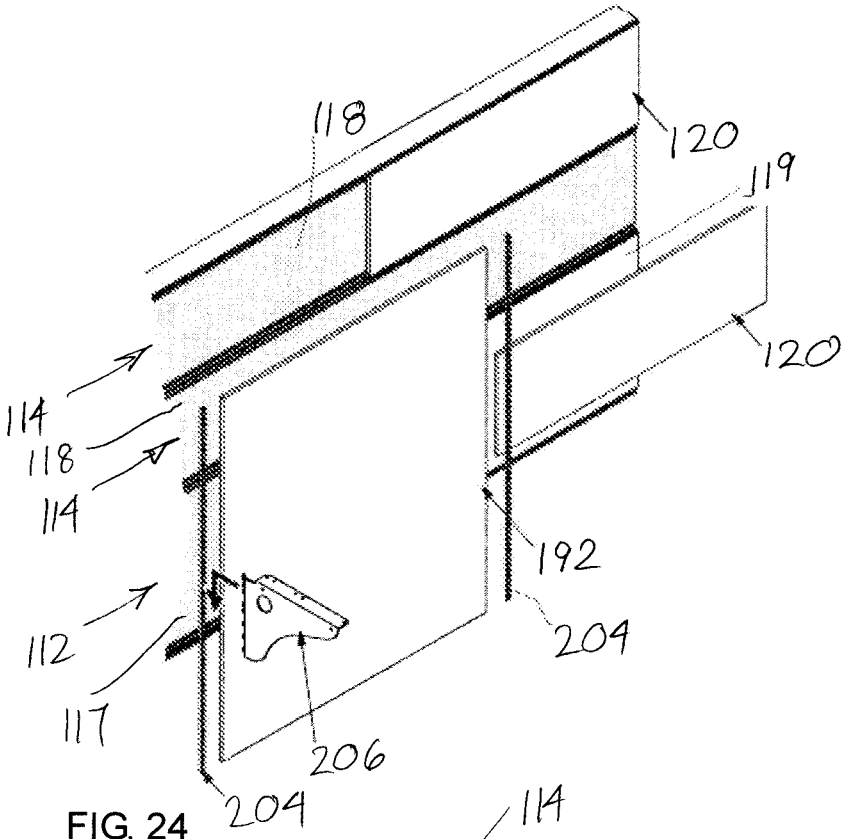
FIG. 24 illustrates a further configuration of wall panels in the wall system with components mounted thereto.
Figure 25:
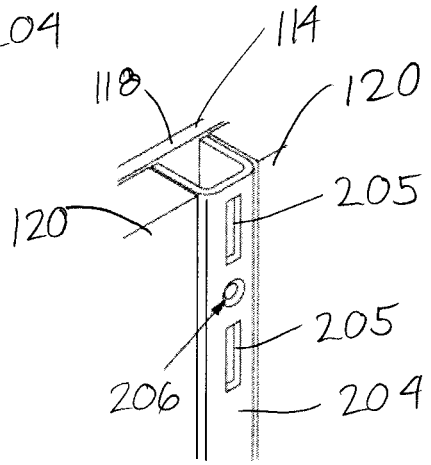
FIG. 25 is an enlarged partial view of the wall panel of FIG. 24.
Figure 26:
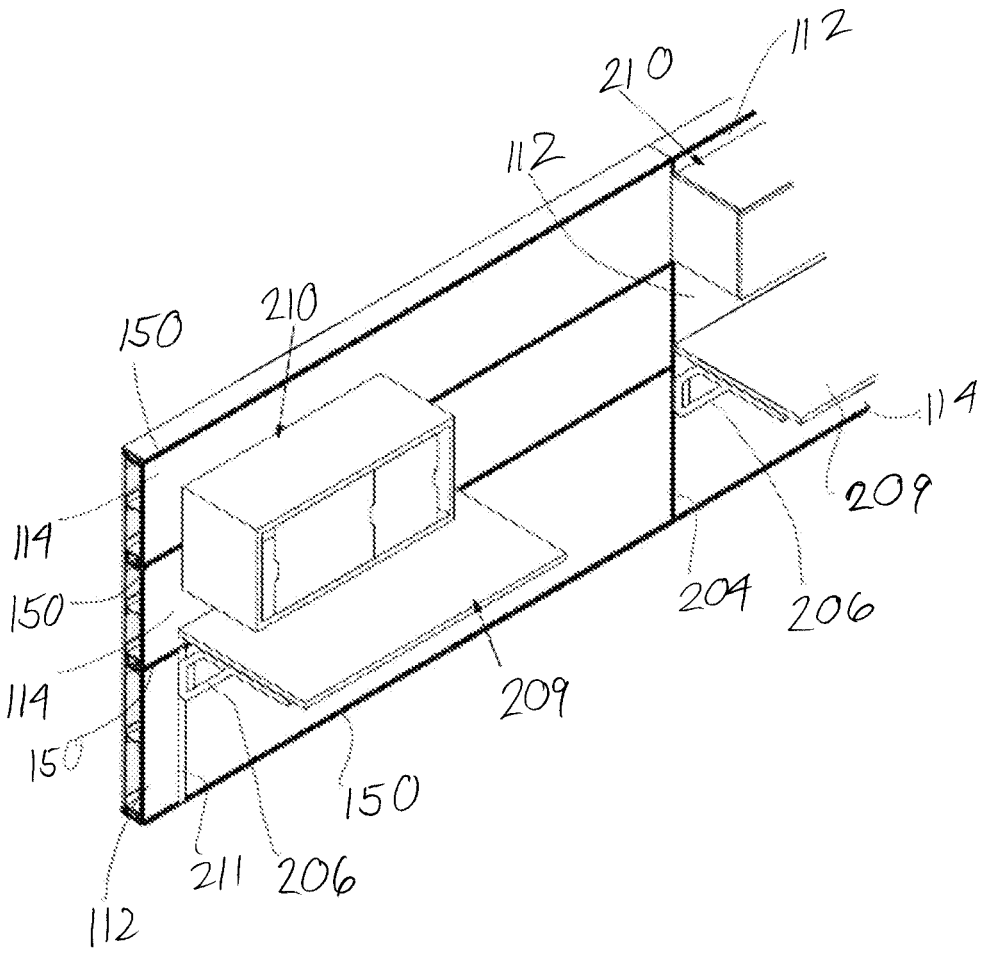
FIG. 26 illustrates a still further configuration of wall panels in the wall system with alternate components mounted thereto.

Referring to FIGS. 24 and 25, the wall system 10 can be provided in other configurations. For example, a wall track 204 may be mounted directly to the wall panels 112 and 114. In this regard, the wall track 204 can be a conventional metal rail with a vertical row of slots 205 for supporting a conventional bracket 206 (FIG. 24). The wall track 204 includes fastener holes 206 through which a fastener can be inserted directly into the facing panel 117 or 118. Since the facing panel 117/118 or even 165/166 can be a conventional sheet material, the fastener can also engage a wall connector such as a conventional drywall anchor to support the wall track 204 on the wall panels 112 and 114.

In this manner, the wall panels 112 and 114 can support various office components such as a work surface 209, an overhead storage cabinet 210, or other conventional furniture components while additional freestanding components (not illustrated) such as chairs, shelf units and filing cabinets can be positioned within the work area. For example, the work surface 209 might be supported on the bracket 206 which is mounted to a wall track 204. Storage cabinet 210 also can be supported on such wall tracks 204 in a modular position aligned with the joint between adjacent wall panels 112 and 114.

Also, an alternate support track 211 might be supported on the mounting rails 150 wherein the support track 211 and the associated bracket 206 can be slid to an off-modular location along the length of the mounting rail 150. In this manner, various functional components can be mounted directly on the wall panels 112 and 114. Similarly, such components also can mount on the wall panels 161 and 162 or other wall panels constructed according to the invention.

Figure 27:
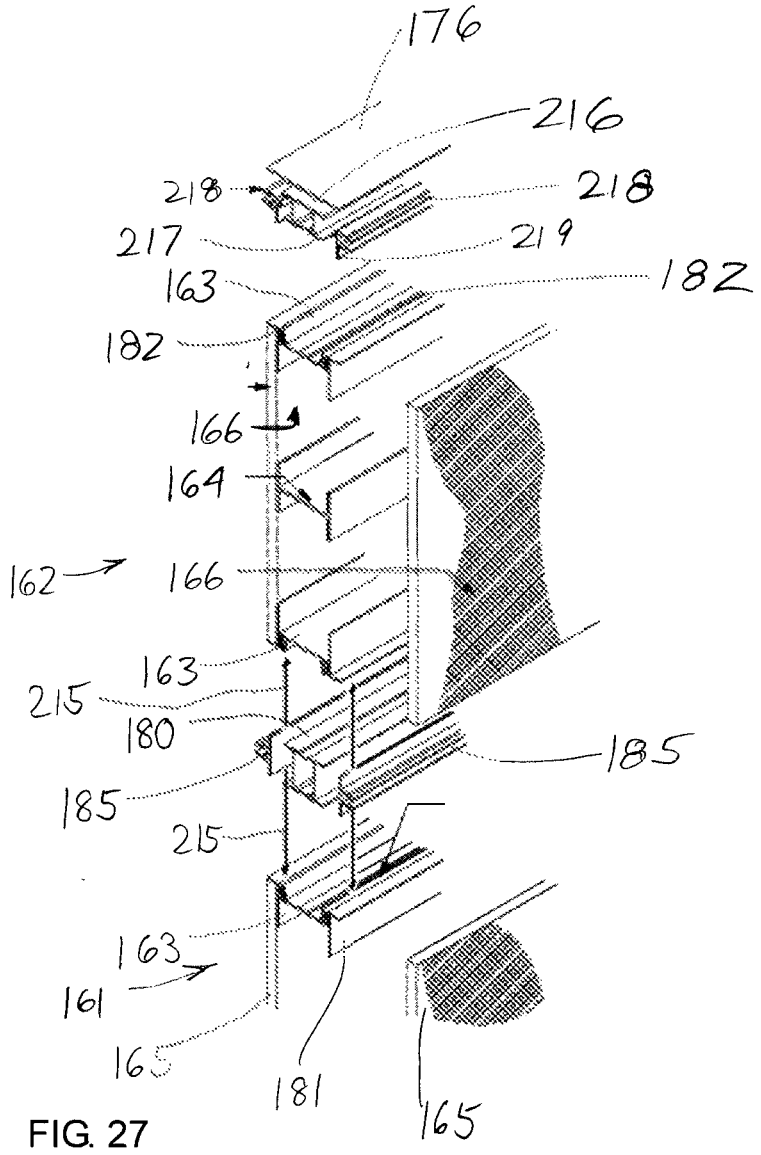
FIG. 27 is an exploded view showing two de-coupled, vertically juxtaposed, horizontally extending wall panels in a first configuration.

FIG. 27 further illustrates the assembly of the wall panels 161 and 162. In this regard, the wall panel 161 comprises the edge rail 163 and the facing panels 165 which are bonded to the flanges 181. The upper wall panel 162 also is formed of the edge rails 163, the interior support rail 164 and the facing panels 166. The two wall panels 161 and 162 are joined together by the key 180 which snaps into both of the edge rails 163 of adjacent wall panels 161 and 162 as indicated by reference arrows 215 to lock the two panels 161 and 162 together along the length of their horizontal edge rails 163. The mounting rails 185 are also installed as indicated by arrows 215 so as to be captured between the two edge rails 163.

At the top of the wall panel 162, the top cap 176 is mounted to the top most edge rail 163 by a top key 216 which has corner flanges 217 that snap into the top edge rail 163 in a similar locking manner as the key 180. Also, a top mounting rail 218 is provided which is similar to rail 185 but only has a single connector flange 219 that slips downwardly into the slot 182 formed in the edge rail 163.

Figure 28:
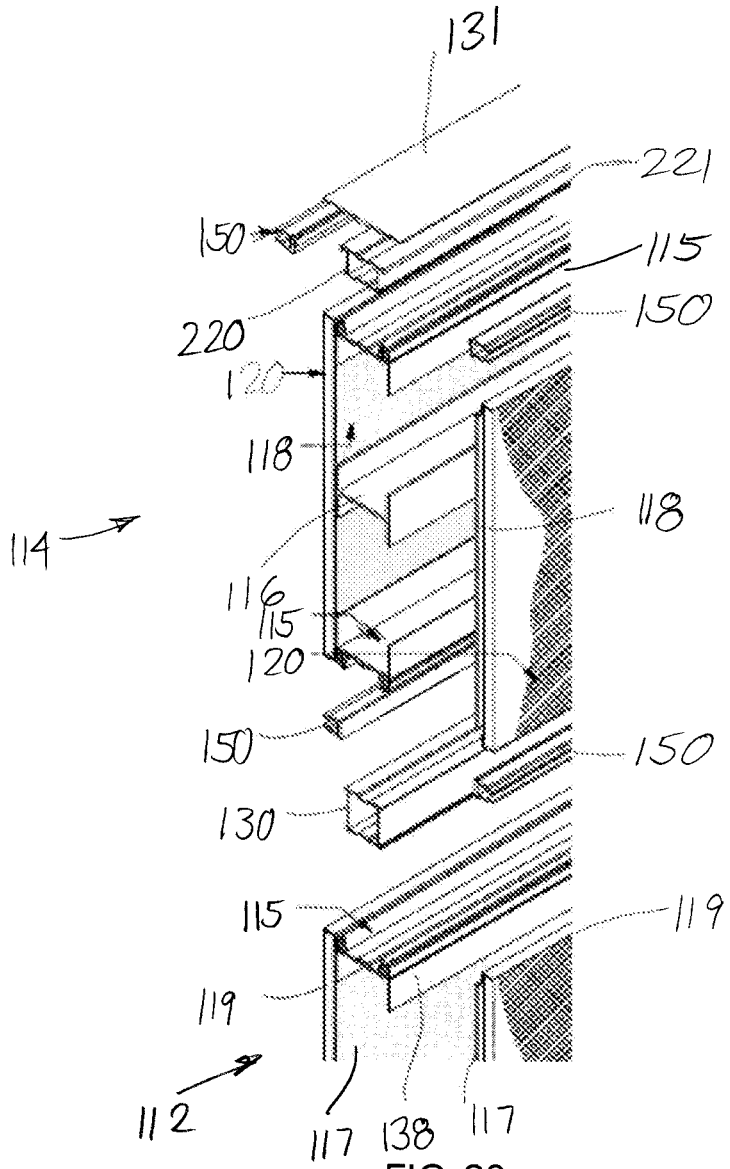
FIG. 28 is an exploded view showing two vertically juxtaposed, horizontally extending wall panels in a second configuration.
Figure 29:
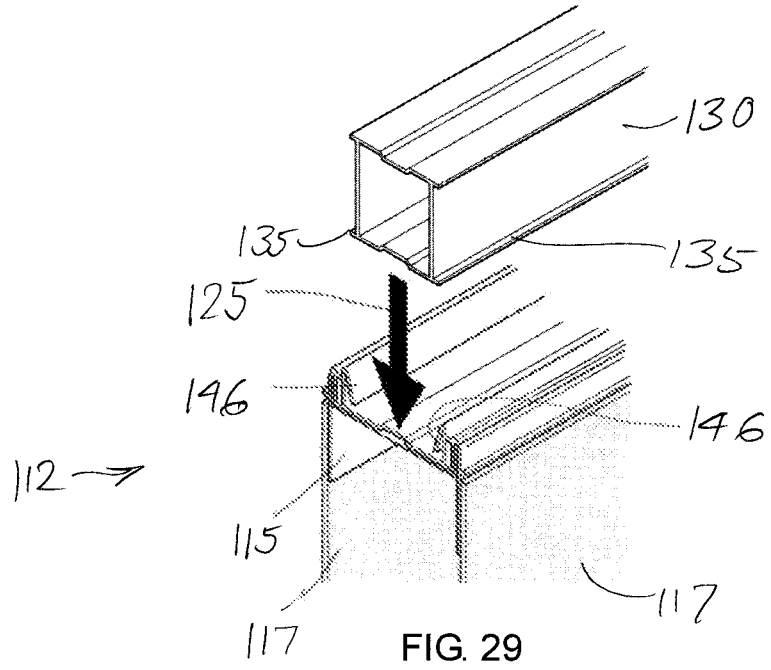
FIG. 29 is an exploded perspective view showing a connector rail or coupler rail being mounted to a wall panel prior to assembly.

FIGS. 28 and 29 further illustrate the assembly of the wall panels 112 and 114. In this regard, the wall panel 112 comprises the edge rail 115 and the facing panels 117 which are bonded to the flanges 138 and then covered by cover panels 119. The upper wall panel 114 also is formed of the edge rails 115, the interior support rail 116 and the facing panels 118 which are covered by cover panels 120. The two wall panels 112 and 114 are joined together by the key 130 which snaps into both of the edge rails 115 of adjacent wall panels 112 and 114 to lock the two panels 112 and 114 together along the length of their horizontal edge rails 115. The mounting rails 150 are also installed typically after the two wall panels 112 and 114 are interconnected together by the key 130.

At the top of the wall panel 114, the top cap 131 is mounted to the top most edge rail 115 by a top key 220 which has corner flanges 221 that snap into the top edge rail 115 in a similar locking manner as the key 130. Also, a top mounting rail 150 is provided for engagement with the top edge rail 115.

As seen in FIG. 29, the key 130 is inserted into the edge rail 115 as indicated by arrow 125 until the corner flanges 135 snap into engagement with the catches 146. The catches 146 deflect upon contact with the corner flanges 135 and then snap back to abut against the corner flanges 135 and thereby secure the key 130 to the respective wall panel 1112.

Figure 30:
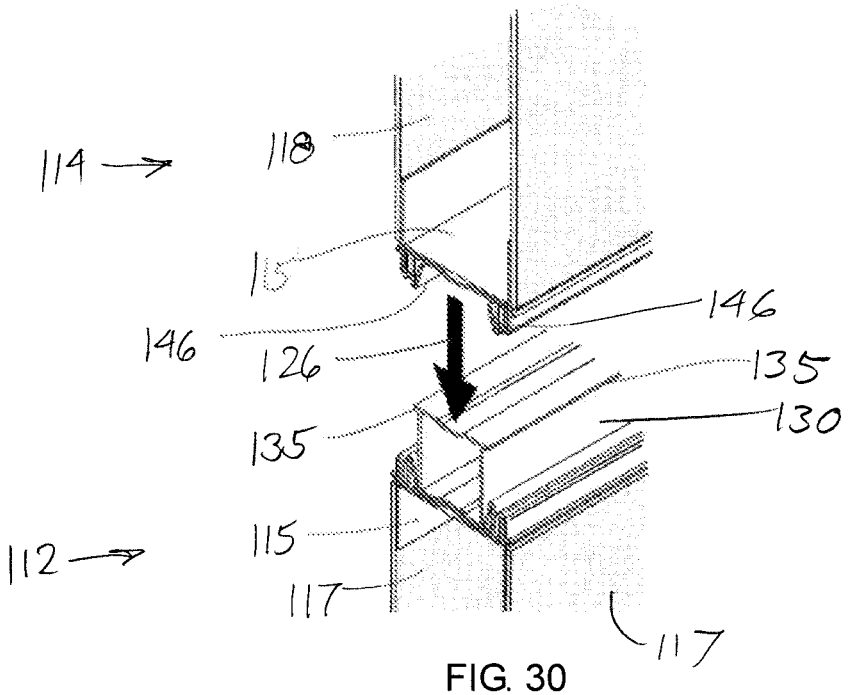
FIG. 30 is an exploded perspective view showing a connector rail being mounted to a wall panel after assembly.
Figure 31:
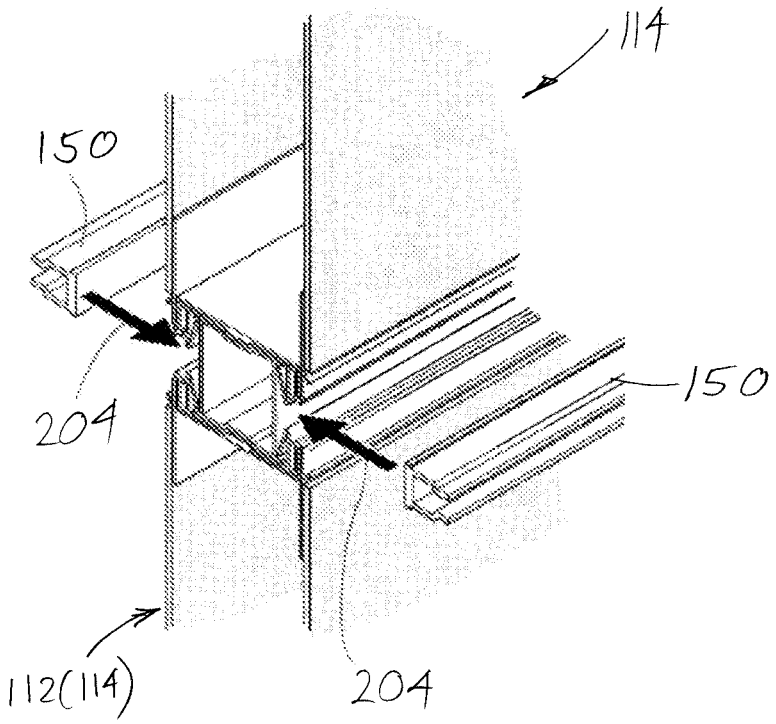
FIG. 31 is an exploded perspective view showing off-modular support rails being installed.

Referring to FIG. 30, the upper wall panel 114 is then shifted downwardly as indicated by arrow 126 wherein its respective catches 146 deflect upon contact with the corner flanges 135 and then snap back to abut against the corner flanges 135 and thereby secure the wall panel 114 to the assembled key 130 and wall panel 112. Referring to FIGS. 31 and 32, the mounting rails 150 can then be snapped into position if desired, and thereafter, as seen in FIGS. 33 and 34, the cover panels 117 or 118 can be snapped into place by engaging the respective hooks 200 and 141 together.

Referring to FIG. 35, to accommodate additional workstation equipment (not illustrated) such as telephones, computers, facsimile machines and the like, the wall panels 161 (or 162, 112 or 114) also selectively include electrical receptacles 172 installed within ports 171. These receptacles can be supplied with power or communications signals with suitable cabling components 170 and 173 which are routed through the hollow interior cavities 167 of the wall panels 161.

Figure 36:
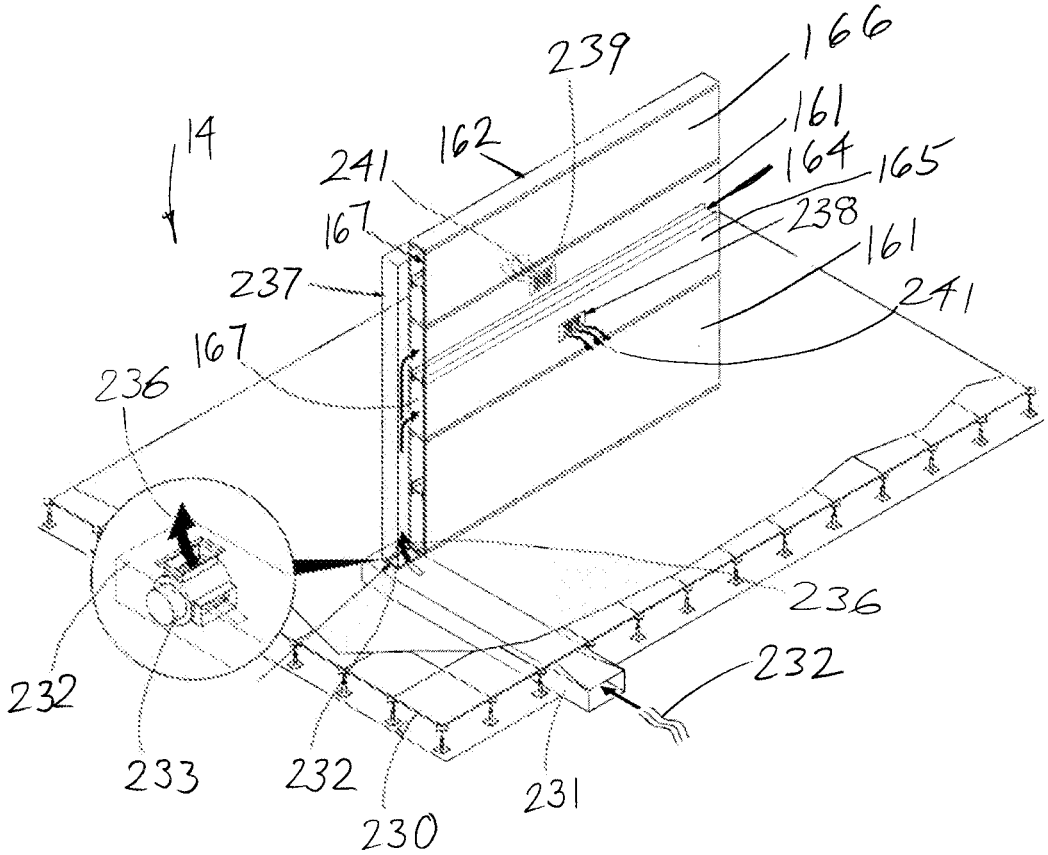
FIG. 36 is a perspective view of HVAC being routed through the wall system.

While the hollow interior cavities 167 of the wall panels 161 provide for the routing of cabling, these interior cavities 167 as well as any internal cavity such as cavities 34, 122, 123 and 168 also can serve the dual function of carrying conditioned air as shown in FIG. 36. As such, the various wall panels described herein serve as HVAC duct work for the distribution of conditioned air through a building space 14.

Figure 40:
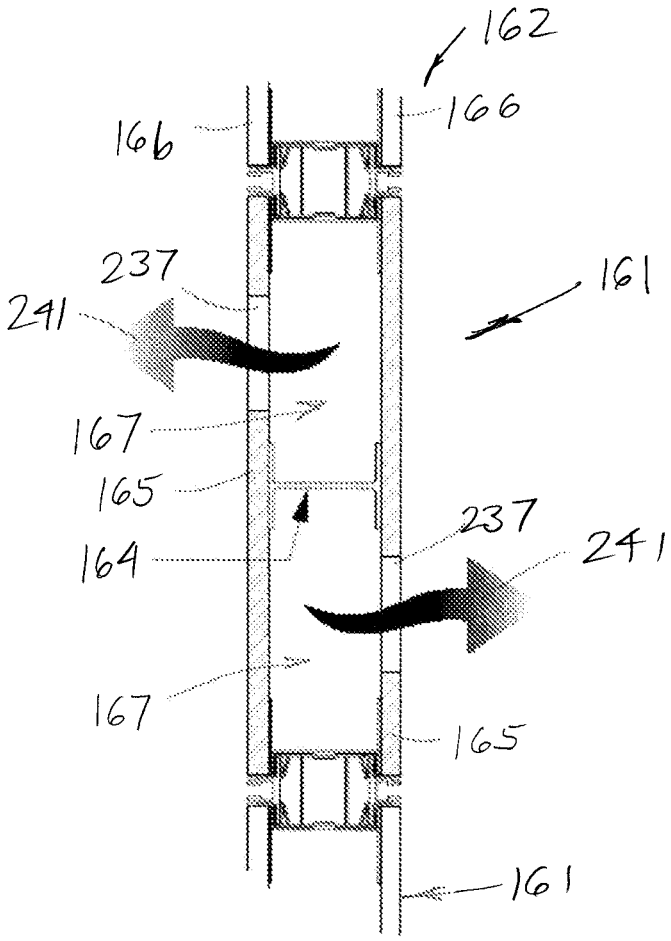
FIG. 40 illustrates the configuration of vent openings within a wall panel and the HVAC and acoustic advantages thereof.

In this regard, the building space 14 commonly may include a raised floor system 230 through which ducts 231 are routed to receive conditioned air 232 therein. One end of the duct 231 terminates at a duct junction 232 which may include an air boost fan 233 for increasing air circulation upwardly through a passage as indicated by arrow 236 to a plenum 237. The duct plenum 237 is a hollow box that has an open side which feeds the air to the ends of the interior wall cavities 167, both above and below the interior support rail 164. Thus, the cavities 167 serve as air ducts for the distribution of conditioned air through the body of the wall panels 161 or 162 as desired. Referring to FIGS. 36 and 40, the facing panels 165 or 166 may then be ported to define openings 237 which are provided with air registers or diffusers 238 and 239 for the discharge of air as indicated by arrows 241. Preferably, the openings 237 are formed in different cavities 167 to improve sound reduction since there are no direct openings from one side of the wall panel 161 to the other wherein the interior support rail 164 serves as an air stop or air flow separator.

Figure 37:
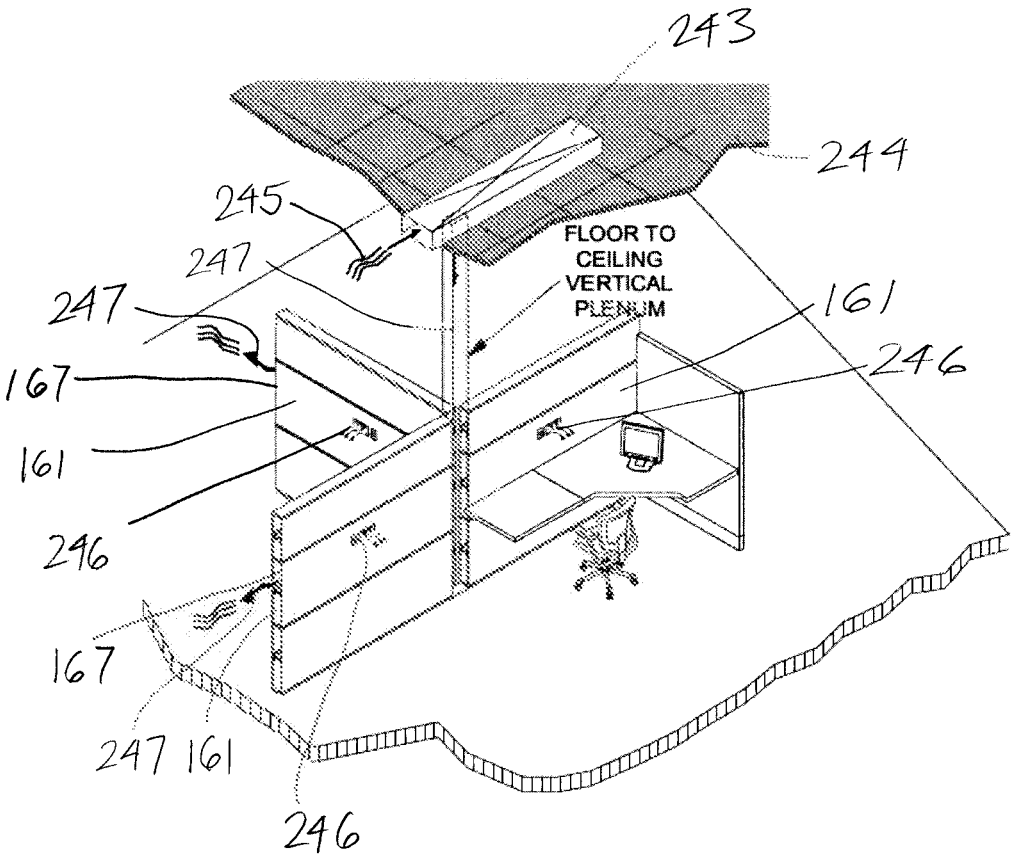
FIG. 37 is a perspective view of an alternate HVAC configuration.

Referring to FIG. 37, an alternate configuration is shown wherein a supply duct 243 is provided above the ceiling 244 to receive air 245. In this embodiment, a floor to ceiling plenum 247 is provided which is open on multiple sides to supply the air from duct 243 to a plurality of wall panels 161 in a three-way corner configuration. The air is supplied to the multiple wall panels 161 which may exit the wall panels 161 through air registers 246. Some of the air may also pass through the wall panels 161 to the far panel end and supply downstream wall panels 161 (not shown but indicated by arrows 247). Hence, the wall panels described herein form an integral part of an air distribution system and allow for the porting of the wall panels at any location using conventional cutting tools.

Figure 38:
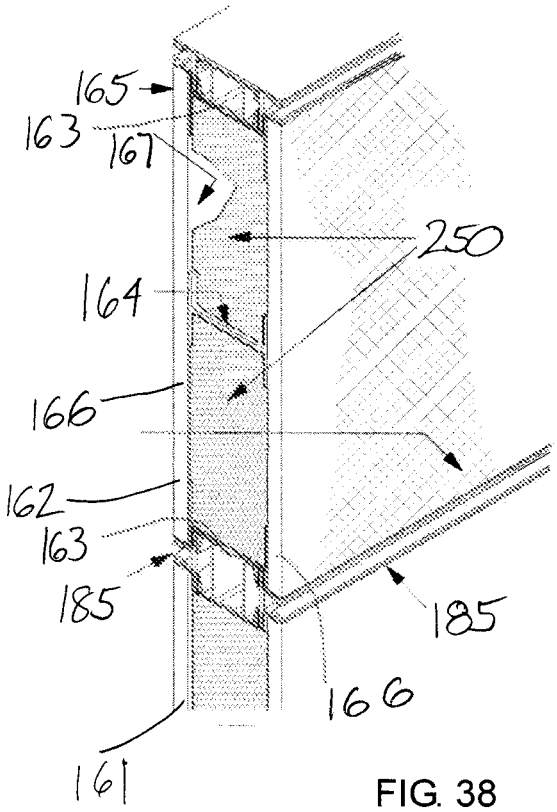
FIG. 38 illustrates an alternate configuration of a wall panel having increased acoustic properties.
Figure 39:
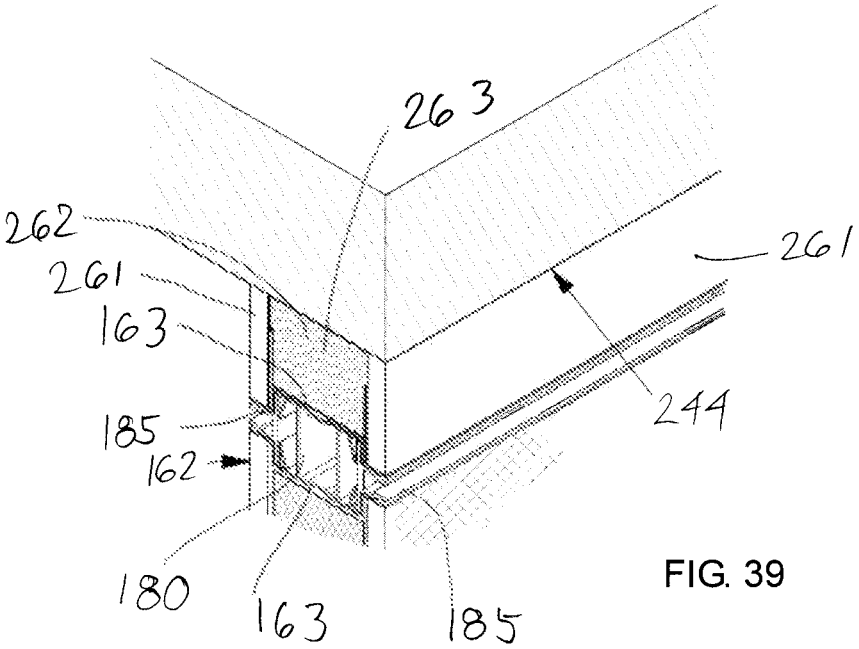
FIG. 39 is a perspective view illustrating an acoustic sealing configuration at the juncture between a wall panel and overhead structure such as a ceiling.

While the interior cavities may be left open to allow for the passage of cabling and air, it also may be desirable to improve the sound reduction capabilities of the various wall panels described herein. For example, FIG. 38 shows the wall panels 161 and 162 wherein the interior cavities 167 are filled with an insulation material 250 in each cavity 167. Preferably, the insulation material 250 is a blown-in insulation which completely fills the cavity space to reduce sound transmission therethrough. Additionally, the snap fit connection of the mounting rails 185 seals the gap between the wall panels 161 and 162 and prevents the formation of sound-transmitting air gaps or sound leaks to avoid acoustic leakage from the wall panel joints.

While the insulation material 250 is provided for sound reduction, the insulation material 250 could also be illustrative of the appearance of the above-described filler material 33-3 which is provided as structural reinforcement for the facing panels 166. In this regard the material 250 could be a rigidifying foam that bonds to the inside faces of the facing panels 166 to completely fill the cavities 167 and rigidify the facing panels 166 of wall panel 162. The other wall panels described herein could also be filled with such a filler material. While the cavities 167 are completely filled, such cavities might be only partially filled and open passages formed through the filler material for the passage of cabling or air.

To prevent passage of sound at the ceiling 244, a transition panel 260 is provided which is affixed to the ceiling 244 and uses an edge rail 163 in combination with short facing panels 261. The transition panel 260 has facing panels 261 which define an interior cavity 262 filled with the above-described insulation 263, wherein the transition panel 260 joins to the top edge rail 263 of a wall panel 162 by a key 180. The joint between the transition panel 260 and the wall panel 162 is sealed by the mounting rails 185 described above. In this manner, an acoustically sealed wall structure can be formed by the various wall panels in combination with a transition panel 260.

Figure 41:
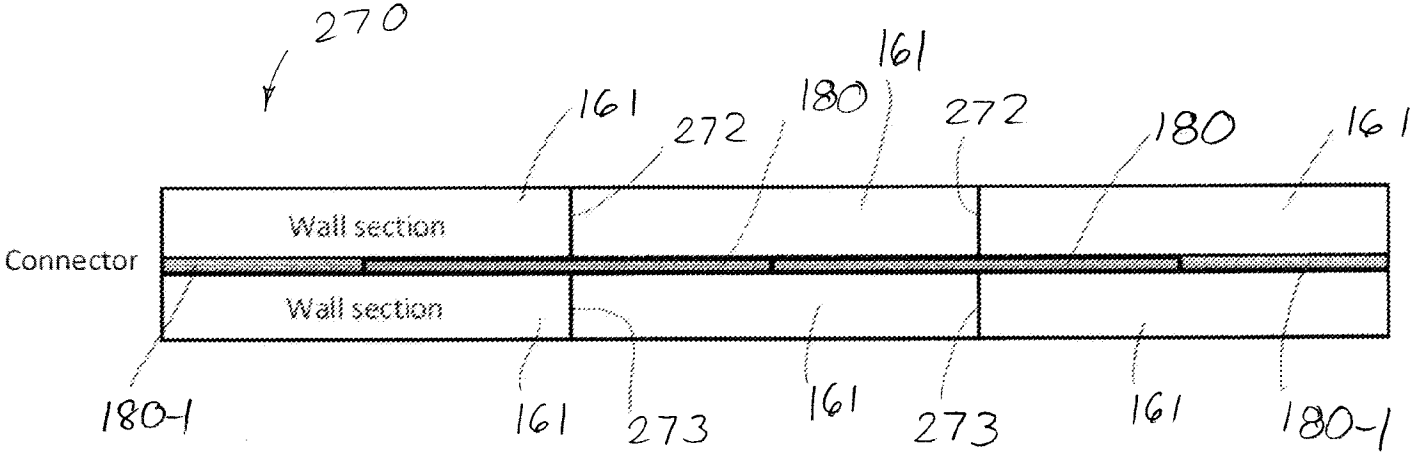
FIG. 41 diagrammatically illustrates one configuration of horizontally oriented wall panels with vertically aligned end edges.
Figure 42:
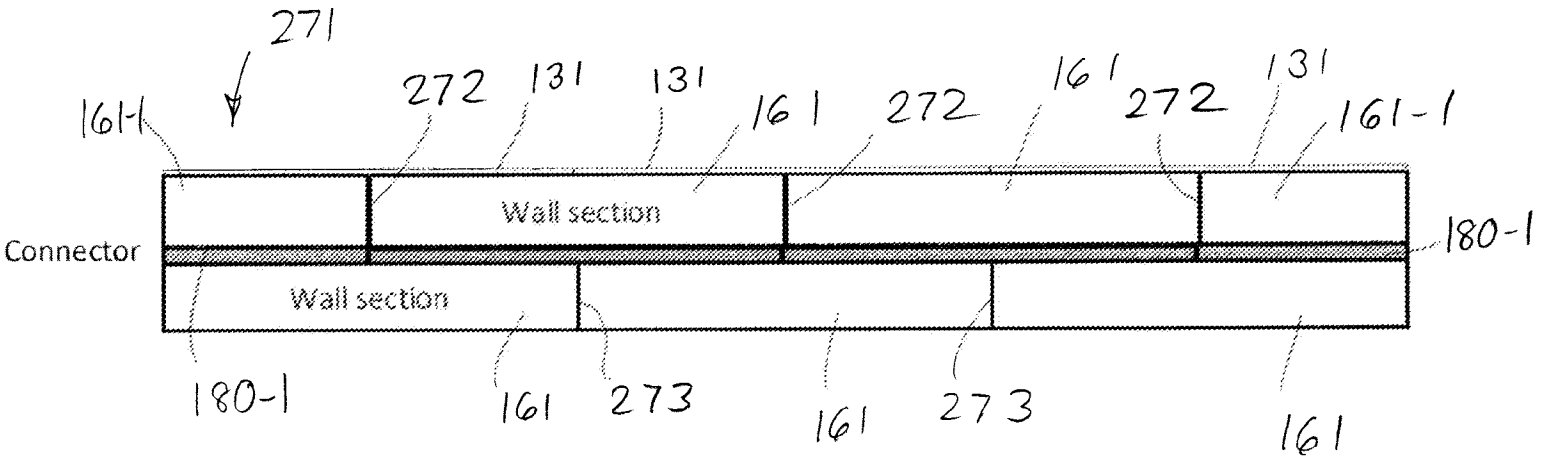
FIG. 42 diagrammatically illustrates a second configuration of horizontally oriented wall panels with staggered or offset end edges.

Referring to FIGS. 41 and 42, long wall runs can be achieved when any of the wall panels described above are oriented horizontally by the provision of the locking structures on the side edge rails. For example, the description of FIGS. 41 and 42 refers to the construction of wall runs 270 and 271 through the use of representative wall panels or wall sections 161 which are stacked one above the other and joined or locked together by the locking key 180. In this illustrated configuration, the wall panels 161 are vertically aligned with each other so that vertical panel joints 272 and 273 are formed between adjacent wall panels 161. Since the wall panels 161 are vertically aligned, the panel joints 272 and 273 are butt joints and are vertically aligned which normally would not structurally connect the sidewardly adjacent wall panels 161 together. However, the locking key 180 is located so that it spans each of the joints 272 and 273 and thereby unitizes the wall panels 161 with each other and forms a rigid wall system. Hence, the locking keys 180 not only join two vertically adjacent wall panels 161 together, one above the other, but also joins sidewardly adjacent wall panels 161 together. At the ends of the wall run 270, the short locking keys 180-1 are provided. Since the locking key 180 is formed as a rail that can be field cut, the locking keys 180-1 may be formed simply by cutting a full length locking key 180 in half with one key half provided at one end of the wall run 270 and the other key half provided at the opposite end of the wall run 270.

FIG. 41 therefore illustrates one configuration of vertically aligned wall panels 161 rigidified by locking keys 180 that span panel joints 272 and 273 located above and below the locking key 180. The second row panels 161 are offset from the first row panels 161 by a half panel length.

FIG. 42 illustrates an alternate configuration of the wall panels 161 which define the wall run 271. In this configuration, the first row of wall panels 161 is laid end to end just like the first row of panels 161 shown in FIG. 41. However, the second row of wall panels 161 is staggered or offset relative to the bottom row, wherein a second row wall panel 161 spans the panel joint 273 of the bottom panel row. The second row panel joints 272 are staggered or offset by a half panel length from the first row panel joints 273 much like a block or brick wall. This configuration does not require any different wall components. Rather, the locking keys 180 are aligned with the second row wall panels 161 so that the locking keys 180 span each panel joint 273 while aligning with the panel joints 272. These keys 180 thereby rigidify the panel joints 273 and vertically join the two rows of wall panels 161 together.

To fill in the ends of the second panel row, a single wall panel 161 can be cut in half to form two short panels 161-1 which are engaged with the bottom panel row by two locking keys 180-1 that are formed by cutting a locking key 180 in half. Placement of top caps 131 on the second row panels 161 would then rigidify the second row where the top caps 131 span the second row panel joints 272.

In another alternate configuration, the locking keys 180 do not need to align with the second row panels 161 of FIG. 42. Rather, the locking keys 180, for example, could be offset by a quarter panel length so that a full length locking key 180 would span both a bottom panel joint 272 and a top panel joint 272. At the ends of the panel run 271, a single length of locking key 180 could be cut so as to define both a quarter length and a three quarter length to fill in the opposite ends of the panel run 271.

The above construction uses common length panels 161 and keys 180. If the ends of either panel run 271 or 272 are cut to less than this panel length, which might be dictated by the building dimensions, the wall panels 161 and keys 180 can simply be field cut to fit. Therefore, all of the above described wall panel components can be provided with this flexibility in constructing panel runs and can be configured to form the wall runs shown in FIGS. 41 and 42, With the architectural wall system described above, an improved wall panel is provided which has significant flexibility in the orientation and field-cutting of the wall panels. Additionally, the various wall panels have significant capabilities with respect to cable carrying capacity, installation of receptacles, HVAC routing and sound transmission improvements.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A space-dividing architectural wall system comprising:

a plurality of interconnected, serially adjacent wall panel box structures for defining work spaces in an open building area having a floor and a ceiling, said wall panel box structures each comprising a plurality of elongate internal support rails which extend lengthwise substantially in parallel wherein said internal support rails at least comprise a pair of edge support rails which are spaced apart in a cross-wise direction and are disposed at lengthwise extending side edges of said wall panel box structures, each of said wall panel box structures further comprising opposite facing panels that are non-removably fastened to opposite surfaces of said edge support rails to prevent movement of said edge support rails and define a structurally rigid tubular wall panel box structure;

said edge support rails maintaining said facing panels in spaced relation and being sidewardly spaced apart in said cross-wise direction to define internal panel cavities between said internal support rails wherein said wall panels define opposite open ends which open in a lengthwise direction of said internal support rails to provide lengthwise internal access to said panel cavities defined between the support rails;

said facing panels and said internal support rails forming a rigid panel structure wherein said internal support rails provide lengthwise rigidity and said facing panels provide lengthwise rigidity in addition to said internal support rails and provide crosswise rigidity to said wall panels;

wherein each of said edge support rails is a one-piece, elongated support rail that includes an integral side edge profile providing a direct interfitting, self-aligning connection with a serially adjacent one of said wall panel box structures with no separate fasteners, said side edge profile including a groove and a rib, said side edge profile further including a planar web that is interposed between said groove and said rib and that is perpendicular to said facing panels, such that said groove and said rib are spaced apart from each other and are complementary to and directly mated with said groove and said rib of said serially adjacent wall panel box structure, wherein said planar webs of serially adjacent edge support rails are spaced apart from each other; and said wall system including a floor-mounted channel and a ceiling channel, said floor-mounted channel attached to said floor, said floor mounted channel including an L-shaped channel body and a removable channel wall attached to said channel body to provide said floor-mounted channel with a generally U-shape, said ceiling channel mounted to said ceiling and being generally U-shaped, whereby said floor-mounted channel receives one of said open ends therein and said ceiling channel receives the other of said open ends therein, said ceiling channel defining a passage formed in said ceiling channel providing access to said internal panel cavities.

2. The wall system according to claim 1, wherein said facing panels are bonded to said edge rails to define face-wise, load-bearing support to said wall panel.

3. The wall system according to claim 2, wherein the rigidity of said facing panels is reinforced by the bonding to said support rails which allows each said wall panel to be oriented vertically wherein the support rails extend vertically.

4. The wall system according to claim 1, wherein said panel cavities allow for the laying of cabling therethrough, and said facing panels are selectively cuttable by tools to define ports.

5. The wall system according to claim 4, wherein said ports receive electrical receptacles therein.

6. The wall system according to claim 1, wherein said wall panels are oriented in an upright vertical orientation wherein the face-wise rigidity of said facing panels carries vertical loads in said upright vertical direction.

7. The wall system according to claim 1, wherein said internal cavities include reinforcing structure on inside faces of said facing panels to maintain said facing panels in parallel, planar orientations relative to each other, said reinforcing structure comprising at least one of said internal support rails engaged between said facing panels, strengthening rib structure on said inside faces and a filler material engaged between said facing panels.

8. A space-dividing architectural wall system comprising:

a plurality of interconnected, serially adjacent wall panel box structures for defining work spaces in an open building area, said wall panel box structures each comprising a plurality of elongate internal support rails which extend lengthwise substantially in parallel wherein said internal support rails at least comprise a pair of edge support rails which are spaced apart in a cross-wise direction and are disposed at lengthwise extending side edges of said wall panel box structures, said wall panel box structures each further comprising opposite facing panels that are non-removably fastened to opposite surfaces of said edge support rails to prevent movement of said edge support rails and define a structurally rigid tubular wall structure;

said edge support rails maintaining said facing panels in spaced relation and being sidewardly spaced apart in said cross-wise direction to define internal panel cavities which are defined between said internal support rails wherein said wall panels define opposite open ends, said internal panel cavities being at least partially open between said opposite open ends which define panel openings which open in a lengthwise direction of said internal support rails to provide lengthwise internal access to said panel cavities;

said opposite facing panels and said internal support rails forming one of said wall panel box structures wherein said internal support rails and said facing panels provide lengthwise rigidity and said facing panels provide crosswise rigidity to said wall panel box structure; and wherein each of said edge support rails is a one-piece, elongated support rail that includes an integral side edge profile configured to provide a direct interfitting, self-aligning connection when joining one of said box structures with a serially adjacent one of said wall panel box structures with no separate fasteners, said side edge profile including a groove and a rib, said side edge profile further including a planar web that is interposed between said groove and said rib and that is perpendicular to said facing panels, such that said rib is spaced apart from said groove, wherein said rib and said groove that are complementary to and directly mate with said groove and said rib of said serially adjacent wall panel box structure, and wherein said planar webs of serially adjacent support rails are spaced apart from each other wherein each of said edge support rails is internal to said facing panels.

9. The wall system according to claim 8, wherein said facing panels are formed of a construction sheet material comprising one of gypsum board, R-board, particle board, mineral board, and cement fiber board.

10. The wall system according to claim 8, wherein removable cover panels are mounted over said facing panels.

11. The wall system according to claim 10, wherein said facing panels are defined by a thin structurally rigid material provided in combination with said cover panels which are thicker and reinforce the rigidity of said facing panels.

12. The wall system according to claim 8, wherein said support rails extend lengthwise and said opposite open ends of said panel cavities open in said lengthwise direction to provide internal access to said panel cavities defined between the support rails.

13. The wall system according to claim 12, wherein said panel cavities receive conditioned air through said open ends for distribution of said conditioned air along the entire length of said wall panel.

14. The wall system according to claim 13, wherein said panel cavities open into communication with said panel cavities of one said wall panel disposed adjacent thereto for distribution of said conditioned air between a plurality of said wall panels.

15. The wall system according to claim 14, wherein said facing panels can be cut by tools to define ports for the discharge of said conditioned air to an exterior of said wall panels.

16. The wall system according to claim 8, wherein said internal cavities are partially filled with insulation through said open ends.

17. The wall system according to claim 8, wherein said facing panels are formed of a cuttable construction sheet material, said facing panels and said internal support rails being field cuttable to at any location between said opposite ends to vary a length of said wall panels while said internal support rails and said facing sheets maintain a rigid, box-like configuration.

18. The wall panel system according to claim 17, wherein said wall panels are cuttable at right angles and at acute angles relative to said edge rails.

19. The space-dividing architectural wall system of claim 8, including a wall mount rail configured to mount to the structural wall of a building structure, said wall mount rail including a groove and rib that are complementary to and mated with said groove and rib of one of said wall panel box structures with said rib of said wall panel box structure extending into said groove of said wall mount rail.

20. The space-dividing architectural wall system of claim 19, including an end cap rail having an arcuate outer wall and an opposing inner wall, said inner wall including a groove and a rib that are complementary to and mated with said groove and said rib on one of said wall panel box structures to form an end cap to the endmost one of said wall panel box structures.

21. The space-dividing architectural wall system of claim 20, including a corner post having a pair of post walls extending perpendicular to one another, each said post wall including a groove and a rib that are complementary to and mated with said groove and said rib on one of said wall panel box structures to form a corner between said wall panel box structures.

22. The wall system according to claim 1, wherein each of said edge support rails is internal to said facing panels, and said edge support rails of serially adjacent wall panel box structures are spaced apart from each other.

* * * * *